US006645056B1

(12) United States Patent
Gilmore et al.

(10) Patent No.: US 6,645,056 B1
(45) Date of Patent: Nov. 11, 2003

(54) SELF-FORMING TOOLING FOR AN ORBITAL POLISHING MACHINE AND METHOD FOR PRODUCING THE SAME

(75) Inventors: James Randall Gilmore, Ligonier, PA (US); Lawrence J. Rhoades, Pittsburgh, PA (US)

(73) Assignee: Extrude Hone Corporation, Irwin, PA (US)

( * ) Notice: Subject to any disclaimer, the term of this patent is extended or adjusted under 35 U.S.C. 154(b) by 33 days.

(21) Appl. No.: 09/711,339

(22) Filed: Nov. 9, 2000

(51) Int. Cl.[7] ..... B24B 7/00
(52) U.S. Cl. ..... 451/270; 451/56
(58) Field of Search ..... 451/270, 54, 55, 451/36, 113, 366, 166, 163, 320

(56) References Cited

U.S. PATENT DOCUMENTS 3,663,785 A * 5/1972 Hausermann ..... 219/69 M
4,277,915 A * 7/1981 Hausermann ..... 51/157
4,656,788 A 4/1987 Rhoades et al.
4,891,916 A 1/1990 Rhoades et al.
5,114,548 A 5/1992 Rhoades
5,125,191 A 6/1992 Rhoades

* cited by examiner

*Primary Examiner*—Dung Van Nguyen
(74) *Attorney, Agent, or Firm*—Webb Ziesenheim Logsdon Orkin & Hanson, P.C.

(57) ABSTRACT

A method for producing, from a blank, restrictive tooling for use in an orbital polishing machine involves urging one of either the workpiece or the blank along a predetermined path against the other to physically impart a proportioned contour of the workpiece into the blank, thereby producing the restrictive tooling. Using this method, the same orbital polishing machine may be used to produce the restrictive tooling and to subsequently polish the workpiece.

29 Claims, 20 Drawing Sheets

SELF-FORMING TOOLING FOR AN ORBITAL POLISHING MACHINE AND METHOD FOR PRODUCING THE SAME

BACKGROUND OF THE INVENTION

1. Field of the Invention

This invention relates to orbital polishing and, more particularly, to a method for forming restrictive tooling used with orbital polishing machining.

2. Background Art

Abrasive flow machining is a well-known, nontraditional machining process whereby'a visco-elastic media, permeated with an abrasive grit, is extruded through or past a workpiece surface to abrade that surface. The abrasive action in abrasive flow machining can be thought of as analogous to a filing, grinding, lapping, or honing operation where the extruded visco-elastic abrasive media passes through or past the workpiece as a "plug". The plug then becomes a self-forming file, grinding stone, or lap as it is extruded under pressure through the confined passageway restricting its flow, thereby abrasively working the selected surfaces of the workpiece. Recently, this technology has been utilized with orbital polishings to create a hybrid technology. Orbital polishing uses much of the same technology as the abrasive flow machining (AFM) process, but adds a mechanical motion to polish three-dimensional forms not possible to be polished by a conventional abrasive flow machining. While AFM requires flow of abrasive media over the workpiece, such flow may or may not be used with the orbital polishing process, since motion is imparted to the abrasive media by the orbital polishing machine independent of any abrasive media flow. Details of an orbital polishing machine may be found in U.S. Pat. No. 4,891,916, which is incorporated herein by reference.

FIG. 1 shows a schematic view of the polishing process using an orbital polishing machine 10. The machine 10 has a first platen 15 upon which a workpiece 20 is secured and a second platen 25 upon which restrictive tooling 30 is secured. Media 35 is introduced between the restrictive tooling 30 and the workpiece 20. When compressed and subjected to elevated pressures, the media 35 forms a mirror image of the workpiece 20 and the restrictive tooling 30 as it conforms to the geometry as a high viscosity elastic fluid. The transfer to an elastic stage helps the media 35 keep the shape of the restrictive tooling 30 and acts as a three-dimensional grinding stone. The first platen 15 and the second platen 25 are then translated relative to one another to produce relative motion between the workpiece 20 and the tooling 30. Preferably, the media 35 adheres to the tooling 30 and slides across the workpiece 20, thereby providing an abrading motion of the media 35 over the face of the workpiece 20.

Using the orbital polishing machining process, the media 35 may be held captive in a vessel 40 between the workpiece 20 and tooling 30 so the only motion of the media 35 is produced by the relative motion of the platens 15, 25 or, as previously mentioned, additional motion may be produced by circulating the media 35 under pressure between the workpiece 20 and the tooling 30. This also acts to exchange the abrasive media 35 at the surface of the workpiece 20 replacing media 35 which is worn, charged with workpiece material or heated (due to elastic and plastic deformation and function) with fresh media at the working surface.

The media employed for orbital polishing is similar to that used in the AFM process. Compared to the media used in the AFM process, the media used in orbital polishing is typically made of a combination of visco-elastic polymer having a higher viscosity with a higher abrasive concentration. While any number of different abrasive media may be used for such polishing, silicon carbide abrasive is most commonly used. Boron carbide and diamond abrasive media are typically used for polishing hard materials and/or for achieving an extremely fine surface finish. However, one of many other abrasives known to those skilled in the art of abrasive materials may be used.

Restrictive tooling is commonly constructed by conventional machining methods or by casting. The preferred material for the restrictive tooling is pressure-molded nylon or polyurethane. Steel or aluminum tools are normally less desirable due to the cost, the weight, the machining difficulty to produce them, and their performance in the polishing process. When the restrictive tooling is made of nylon or polyurethane, the abrasive media tends to adhere to restrictive tooling rather than to the workpiece. However, polyurethane restrictive tooling normally requires shaping to create the required gap and also exhibits only moderate wear resistance. Nylon tooling, on the other hand, offers greater wear resistance but requires machining which can detract from the time saving offered by the orbital polishing process.

The restrictive tooling 30 for orbital polishing must be constructed to create a restriction in three-dimensional parts. When restrictive tooling is required, tooling is constructed to be the offset mirror image of the workpiece 20. The clearance between the workpiece 20 and the restrictive tooling 30 is provided for the media 35 layer to simulate a flexible grinding stone effect as well as to accommodate the orbital motion.

The orbital amplitude of the polishing machine determines the movement of the cutting edges embedded in the media. Larger amplitudes yield larger movement of the cutting edges which encourage larger material removal. However, as will be explained in more detail, the orbital amplitude should not be larger than the minimum concave or internal geometry of the workpiece. Smaller orbital amplitudes decrease the relative motion of the abrasive cutting edges against the workpiece. These two limitations define the geometrical limitations of the application of the orbital polishing process.

Nevertheless, for orbital polishing to be successful, it is very important that the restrictive tooling be formed to be the approximate mirror image of the workpiece to create a uniform gap between the workpiece and the restrictive tooling in which the abrasive media may rest. This uniform gap is important because a media of uniform thickness across the face of the workpiece provides a uniform force against the workpiece by the tooling.

Once the restrictive tooling is fabricated, it must then be properly mounted upon the orbital polishing machine so that it is properly aligned with the associated workpiece.

One object of the present invention is to provide a method and an apparatus for producing restrictive tooling using a simple and effective process that provides such tooling in a relatively short period of time.

Another object of the present invention is to permit the fabrication of restrictive tooling using a workpiece mounted upon an orbital polishing machine and then to use the same restrictive tooling on the same orbital polishing machine to polish the workpiece.

Still other objects of the present invention will become apparent to those of ordinary skill in the art upon reading and understanding the following detailed description.

SUMMARY OF THE INVENTION

One embodiment of the subject invention is directed to a method for producing, from a blank, restrictive tooling for use with a flowable abrasive media upon a workpiece in an orbital polishing machine wherein the workpiece has a particular contour, the method comprising the step of urging one of either the workpiece or the blank along a predetermined path against the other to physically impart a proportioned contour of the workpiece into the blank thereby producing the restrictive tooling within the blank.

The relative motion between the workpiece and the blank may be any oscillatory motion, including translational, orbital, gyrating, linear or reciprocating motion.

This method may further comprise the intermediate steps of: (a) producing a first molded body using the contoured blank as the pattern, whereby the first molded body is a negative image of the contoured blank; and (b) producing a second molded body using the first molded body as the pattern, whereby the second molded body is a negative image of the first molded body and duplicates the shape of the contoured blank and whereby the second molded body may be used as the restrictive tooling.

Another embodiment is directed to a method using an orbital polishing machine for producing restrictive tooling that may be used in an orbital grinding operation comprised of the steps of:

a) mounting upon a first platen of an orbital grinding machine a workpiece;

b) mounting upon an opposing second platen of the orbital grinding machine a blank made of a material softer than that of the workpiece;

c) energizing the orbital grinding machine to produce relative motion between the workpiece and the blank;

d) advancing the first platen and the second platen toward each other until the workpiece penetrates the blank a predetermined depth to define a cavity or "core"; and e) after the cavity has been formed, retracting the first platen and the second platen from each other.

Yet another embodiment is directed to a method of producing and utilizing restrictive tooling for an orbital polishing operation further comprised of the additional steps of:

f) applying a layer of abrasive media associated with orbital polishing between the workpiece and the tooling;

g) advancing the first platen and the second platen toward each other until the blank and tooling are separated a predetermined distance; and h) energizing the orbital polishing machine to create relative motion between the abrasive media and the workpiece to polish the workpiece.

Still another embodiment is directed to restrictive tooling produced by the method comprising the step of urging one of either or both the workpiece or the blank along a predetermined path against one another to physically impart a proportioned contour of the workpiece into the blank thereby producing the restrictive tooling.

It is possible to utilize a single orbital polishing machine to both produce restrictive tooling using a workpiece and then to subsequently polish that workpiece using the same restrictive tooling.

DETAILED DESCRIPTION OF THE PREFERRED EMBODIMENT

Figure 1:
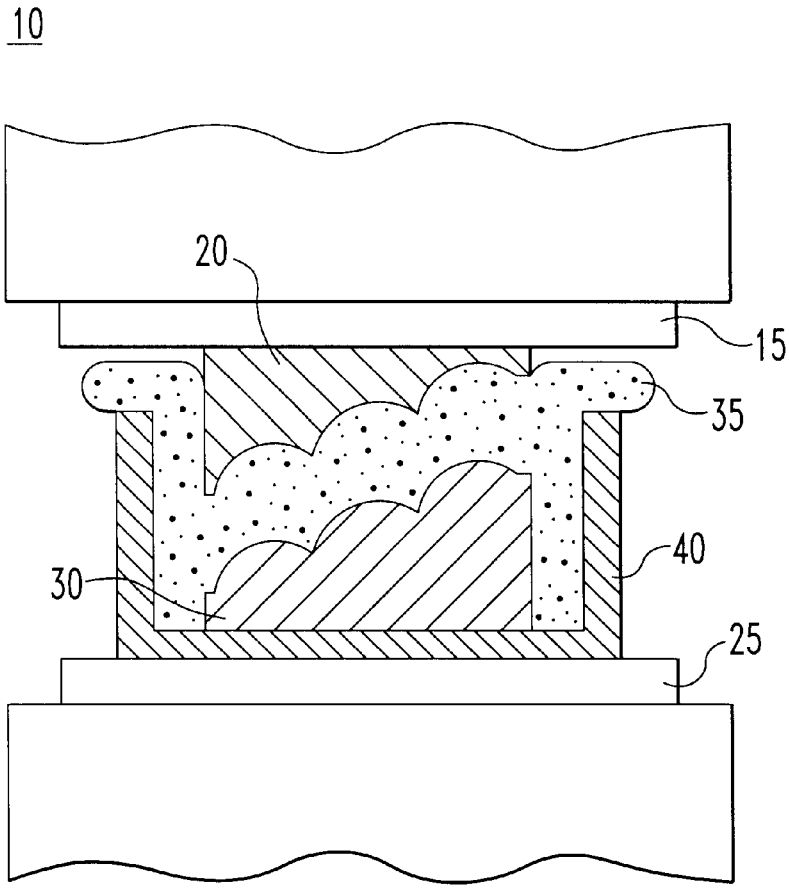
FIG.1 PRIOR ART
FIG. 1 is prior art and illustrates a schematic of an orbital polishing machine and of the orbital polishing process.
Figure 2:
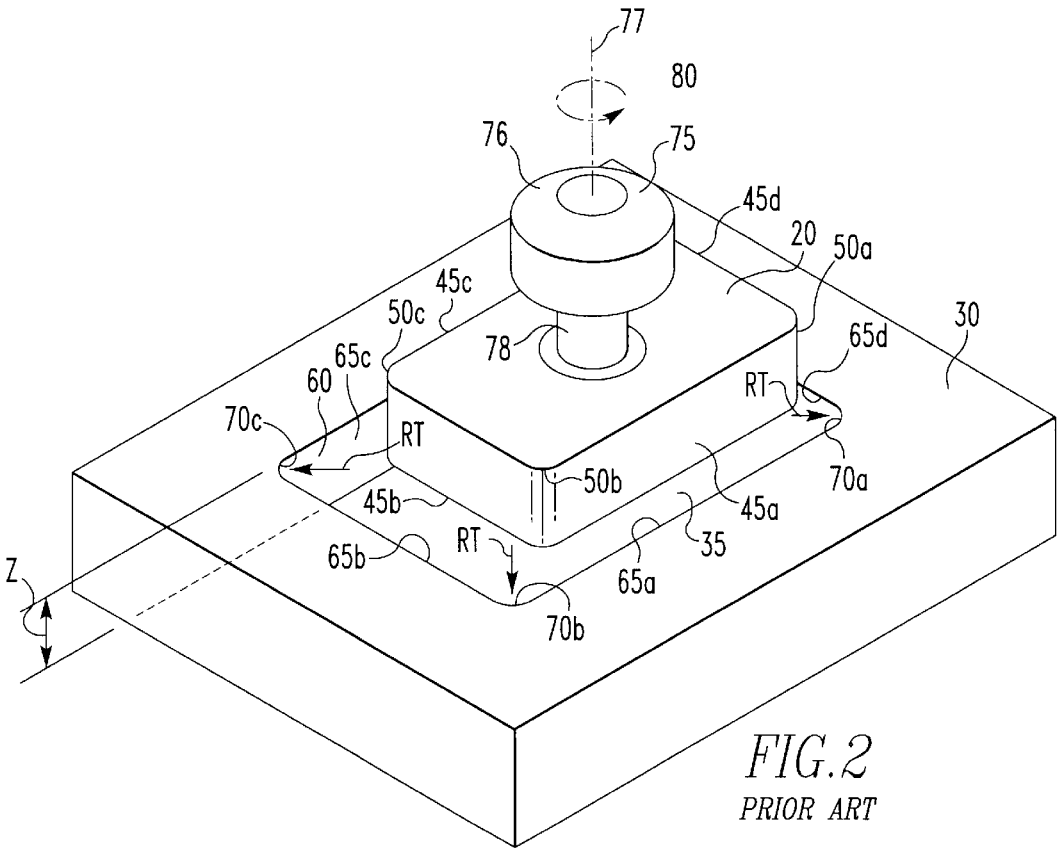
FIG.2 PRIOR ART
FIG. 2 is prior art and illustrates a perspective view of a schematic illustrating the orbital polishing process.
Figure 3:
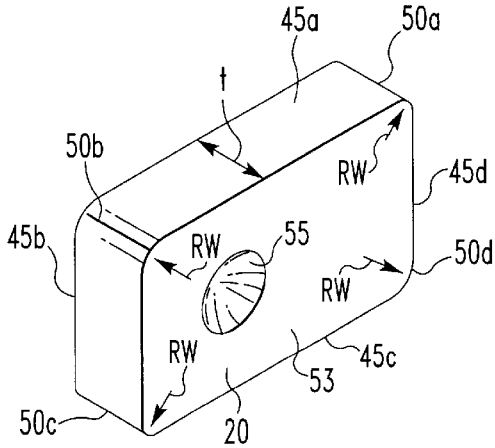
FIG. 3 illustrates a perspective view of a workpiece that may be polished using the orbital polishing process.

To understand the invention, it is first necessary to understand the orbital polishing process. FIG. 2 illustrates a perspective view of the orbital polishing machine 10 by which a workpiece 20 is urged against restrictive tooling 30 through an abrasive media 35. While the schematic in FIG. 1 illustrates a first platen 15 and a second platen 25, for purposes of this explanation, they will not be illustrated. In the arrangement illustrated in FIGS. 2 and 3, the workpiece 20 is comprised of a shape having four walls 45*a*–45*d* connected with corners 50*a*–50*d* each having a radius RW associated with them. It is not necessary for the value of RW for each corner to be equal. As further illustrated in FIG. 3, which shows the underside of the workpiece 20, the workpiece 20 has a flat bottom 53 and an internal recess 55 of a generally curved dome shape extending partway through the thickness t of the workpiece 20.

The restrictive tooling 30 is prefabricated with a cavity 60 which generally conforms to, but is larger than, the outer perimeter of the workpiece 20. Additionally, the cavity 60 may have a depth Z greater than the thickness t of the workpiece 20.

The oversized nature of the cavity 60 permits the introduction of the abrasive media 35 between the workpiece 20 and the restrictive tooling 30, thereby permitting the implementation of the orbital polishing process. For purpose of clarity, the media 35, illustrated in FIG. 1, will not be illustrated in subsequent Figures, but will be discussed with the understanding that it is used to fill the gap between the restrictive tooling 30 and workpiece 20, and its location between the restrictive tooling 30 and the workpiece 20 will be noted with reference numeral 35.

The cavity 60 in the restrictive tooling 30 has complementary sidewalls 65*a*–65*d* and complementary corners 70*a*–70*d* corresponding with associated walls and corners on the workpiece 20. The corners 70*a*–70*d* have associated with them radii RT.

With the media 35 in place and with the workpiece 20 positioned within the cavity 60, an orbital driver 75 imparts only translation to the workpiece 20 along a circular path 80 which is defined by the contour of the cavity 60. However, such translation is limited to maintain a gap between the workpiece 20 and the restrictive tooling 30 in which the media 35 resides. In this fashion, shear forces are imparted to the media 35 between the workpiece walls 45*a*–45*d* and the restrictive tooling walls 65*a*–65*d*. Upon experiencing a shear load, the media 35 stiffens up and preferably adheres to the tooling 30 such that further motion causes sliding between the media 35 and the workpiece 20, thereby permitting the media 35 to essentially polish the workpiece 20.

It should be noted that the orbital driver 75, as illustrated in FIG. 2, does not impart any relative rotation between the workpiece 20 and the tooling 30, but by design transmits only translational forces along a predefined path which, in FIG. 2, is the circular path 80. As an example, orbital driver 75 may be comprised of a cam plate 76 rotating about an axis 77. A post 78 is attached to the plate 76 and rotatably attached to the workpiece 20. The post 78, however, is offset relative to the axis 77 such that rotation of the plate 76 moves the workpiece 20 about the circular path 80 defined by the offset of the post 78. Such a device is further described in previously mentioned U.S. Pat. No. 4,891,916.

As a further example, FIGS. 4A, 5, 6, 7A, and 8 illustrate a top view of a schematic showing this relative motion between the workpiece 20 and the restrictive tooling 30. FIGS. 4B and 6B illustrate cross-sectional side views of those views in FIGS. 4A and 7A, respectively.

Although the workpiece 20 is translated without relative rotation about the cavity 60, such translation may be imparted along the circular path 80 offset a predetermined distance from the axis 77 of the orbital driver 75. This offset distance "d" is the radius of circular path 80 and is illustrated in FIG. 4A.

Figure 4A:
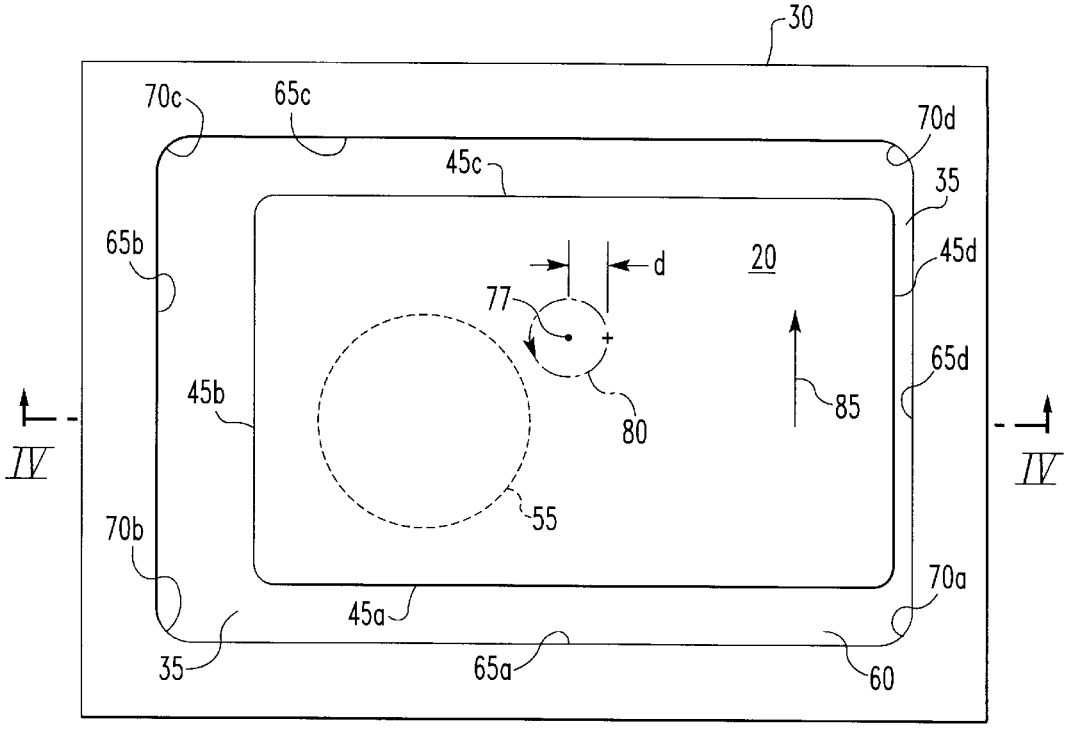
FIG. 4A PRIOR ART
FIGS. 4A, 5, 6, 7A and 8 are prior art and illustrate a top view showing different positions of the workpiece relative to the restrictive tooling during the orbital polishing process.
Figure 4B:
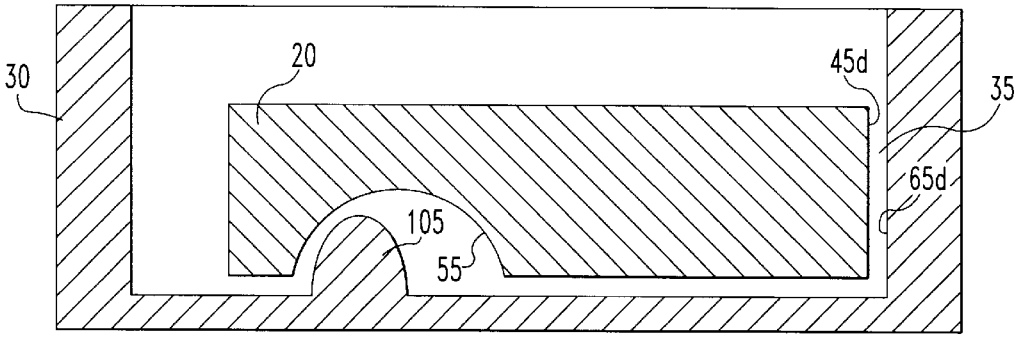
FIG. 4B PRIOR ART
FIGS. 4B and 7B are prior art and illustrate cross-sectional side views along arrows IV—IV and VII—VII in FIGS. 4A and 7A, respectively.

In FIG. 4A, side 45*d* of the workpiece 20 is positioned closest to sidewall 65*d* of the cavity 60, and the workpiece 20 is moving laterally against the cavity 60 as illustrated by arrow 85. The cavity 60 is filled with media 35 such that there is a layer of media 35 between the workpiece 20 and the tooling 30. When the gap between the workpiece 20 and tooling 30 is minimized and there is relative motion between them, then the media 35 stiffens, i.e., the viscosity increases, and the media 35 may adhere to the tooling 30 or elastically deflect into the gap, thereby causing the stiffened media to slide against the workpiece 20 to provide the desired abrasive action. This motion occurs across the surface of the workpiece 20.

The gap is minimized by the translation of the workpiece 20 about the offset circular path 80 about an axis 77. This offset distance "d" is also referred to as the amplitude of the translation of the workpiece 20.

Figure 5:
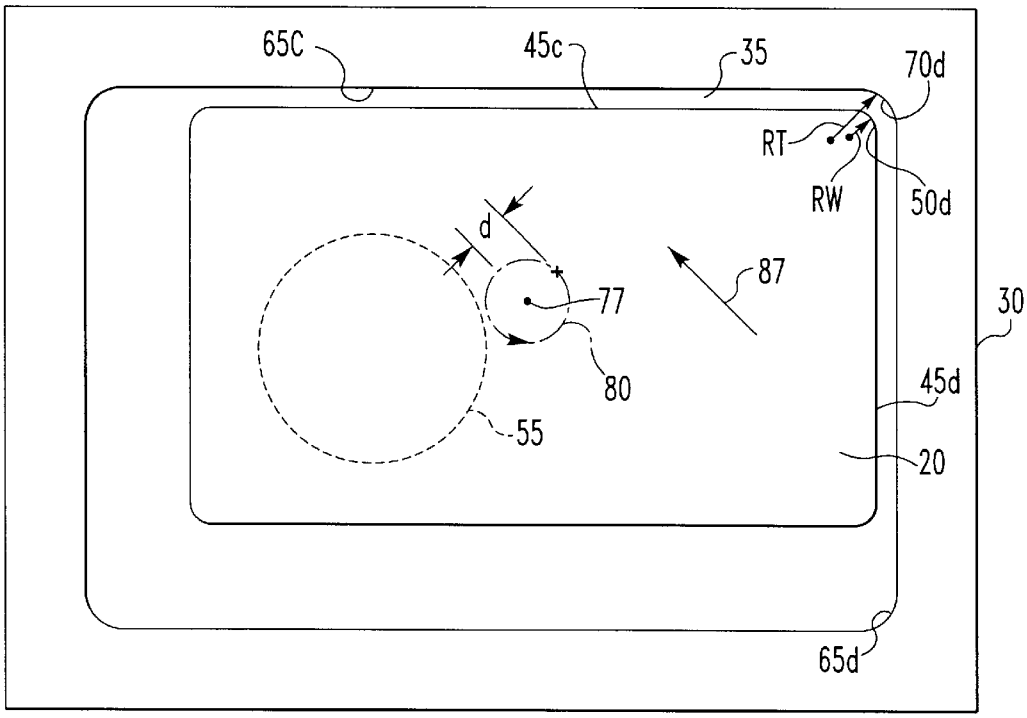
FIG. 5 PRIOR ART

Directing attention to FIG. 5, the workpiece 20 is moving in a lateral direction represented by arrow 87 such that the corner 50*d* of the workpiece 20 is closest to the corner 70*d* of the tooling 30 permitting the media 35 to act against the corner 50*d* of the workpiece 20.

Note the radius RW of corner 50*d* of the workpiece 20 is less than the radius RT of the corner 70*d* in the restrictive tooling 30.

Since the workpiece 20 is laterally displaced about the circular path 80, then in order to maintain a uniform minimum gap between the walls 45*a*–45*d* of the workpiece 20 and the walls 60*a*–60*d* of the restrictive tooling 30, any concave or convex surfaces of the workpiece 20 must be represented as exaggerated by corresponding surfaces on the restrictive tooling 30. For this reason, in each corner the radius RT is larger than the radius RW by the amount of offset distance "d". This phenomenon occurs in each corner 50*a*–50*d*.

Just as the radius RT discussed in FIG. 5 relative to radius RW of the workpiece 20 must be exaggerated, so, too, must the associated shapes of other concave or convex surfaces on the workpiece 20. With reference to FIG. 4B, which is a cross-sectional side view of the arrangement illustrated in FIG. 4A, in order to polish the inside of the recess 55 on the workpiece 20, the restrictive tooling 30 must have a protrusion 105 which generally approximates the shape of the recess 55 but, for reasons previously discussed, has a slightly different profile. Specifically, the protrusion 105 in restrictive tooling 30 has a smaller profile and has surfaces with smaller radii at selected points than the profile and the surfaces of the mating recess 55. This, again, is to maintain a minimum distance between the workpiece 20 and the restrictive tooling 30 such that the media 35 exerts a uniform pressure upon all parts of the workpiece 20.

Figure 6:
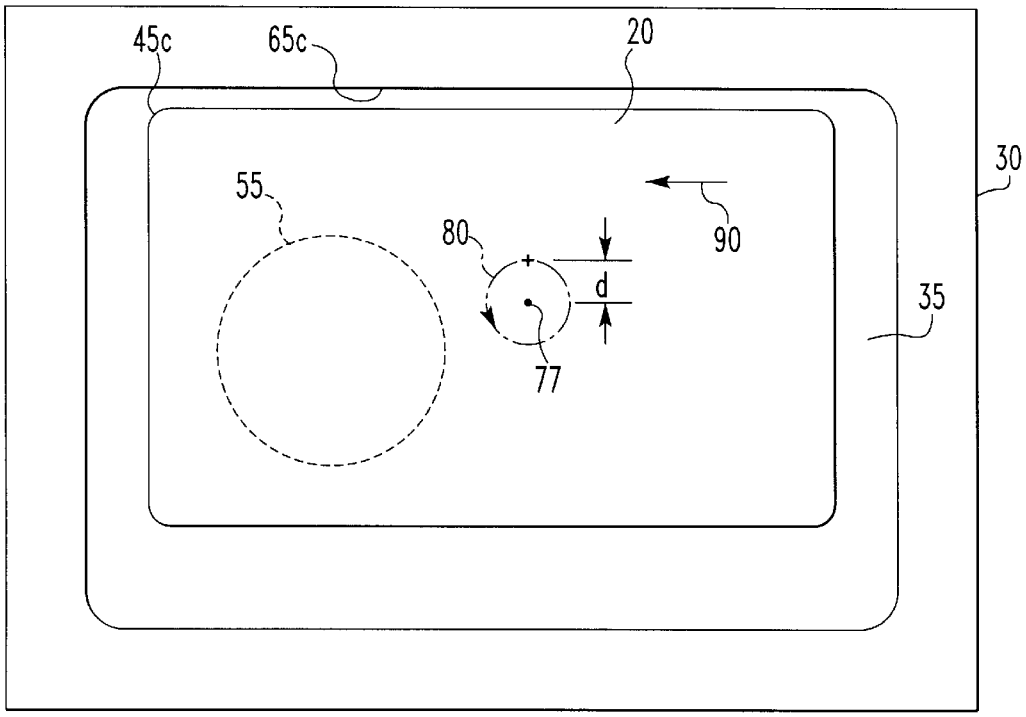
FIG. 6 PRIOR ART

Directing attention to FIG. 6, wall 45*c* of the workpiece 20 is now closest to wall 65*c* of the restrictive tooling 30, and lateral motion in the direction of arrow 90 produces the desired shear upon the media 35, thereby imparting polishing to the wall 45*c* of the workpiece 20.

Figure 7A:
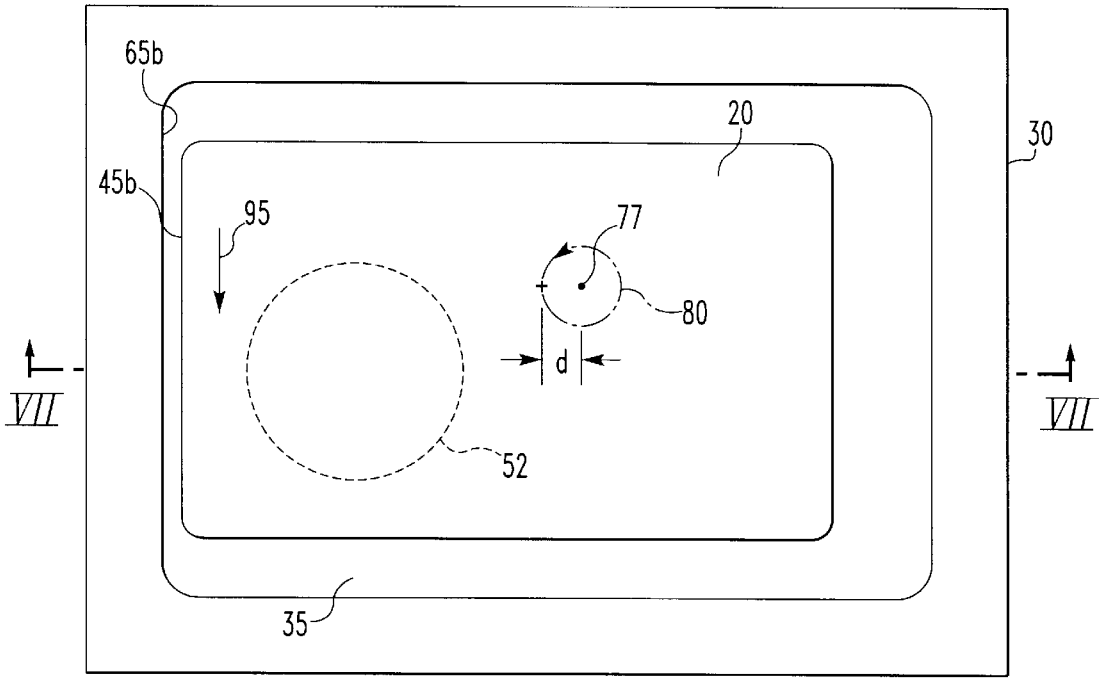
FIG. 7A PRIOR ART

Directing attention to FIG. 7A, the same phenomenon now occurs as a workpiece 20 moves in the direction of arrow 95 to impart shear to the media 35 which is situated between the wall 45*b* of the workpiece 20 and wall 65*b* of the restrictive tooling 30.

Figure 8:
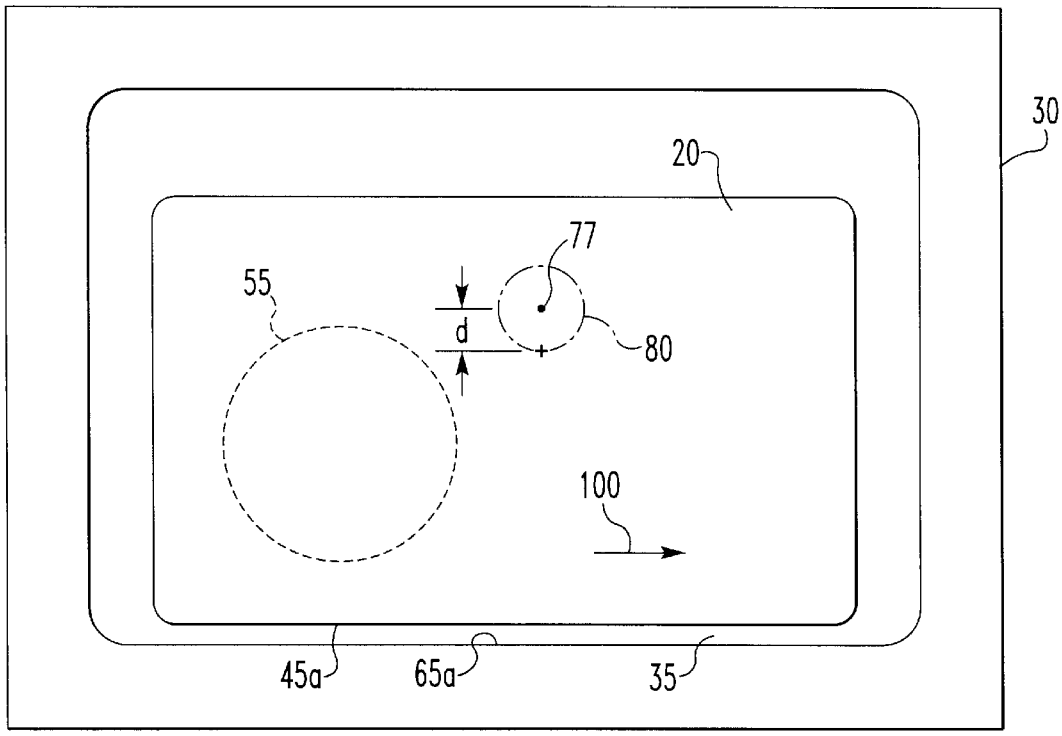
FIG. 8 PRIOR ART

Finally, as illustrated in FIG. 8, the workpiece 20 is moved in the direction of arrow 100 such that the media 35 between the wall 45*a* of the workpiece 20 and wall 65*a* of the restrictive tooling 30 is placed in shear, thereby resulting in a polishing action on wall 45*a*.

Figure 7B:
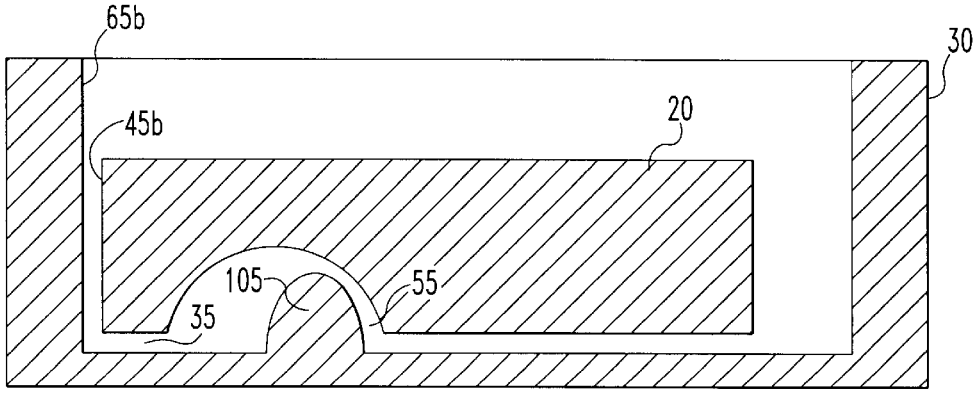
FIG. 7B PRIOR ART

While FIG. 4B shows the workpiece 20 with wall 45*d* of the workpiece 20 closest to wall 65*d* of the restrictive tooling 30, FIG. 7B shows the workpiece 20 with the wall 45*b* closest to the wall 65*b* of the restrictive tooling 30. In this instance, the projection 105 is closest to an opposing side of the recess 55 of the workpiece 20 in a fashion opposite to that illustrated in FIG. 4B.

Throughout the discussion a minimum gap has been mentioned between the workpiece 20 and the restrictive tooling 30 necessary to effectively utilize the media 35. A typical minimum gap may be approximately 3 mm.

With this in mind, the inventor has discovered the same translational motion used between the workpiece 20 and the restrictive tooling 30 for producing shear upon the media 35, thereby polishing the walls of the workpiece 20, may be used to produce restrictive tooling 30 in an inexpensive and effective manner.

Returning briefly to FIGS. 4A–8, the amplitude of the displacement of the workpiece 20 relative to the axis 77 of the orbital polishing machine is illustrated by offset distance "d". While the workpiece 20 is translated an offset distance "d" about the circular path 80, no portion of the workpiece 20 will directly contact the restrictive tooling 30. A known minimum gap will be retained throughout the process.

On the other hand, the inventor has realized that if the offset distance "d", which is the amplitude, illustrated in FIGS. 4A–8 were to be increased such that there was physical interference with the restrictive tooling 30, then it is possible to produce restrictive tooling from a blank taking advantage of this motion of the workpiece 20.

Figure 9A:
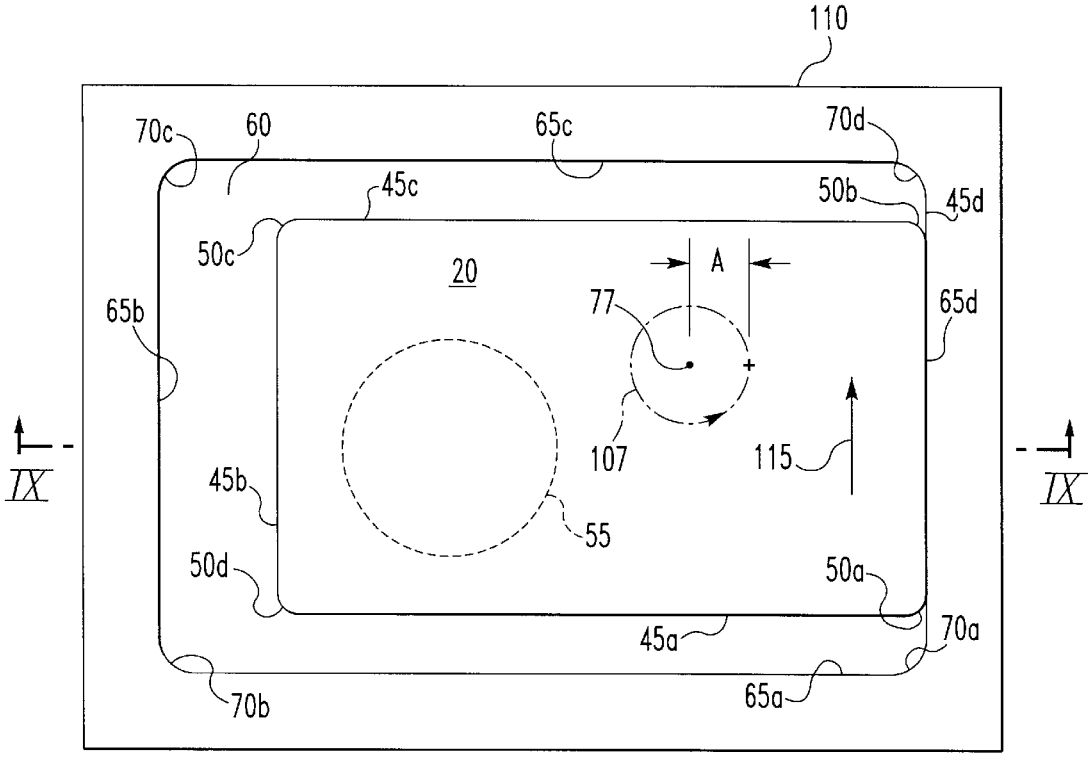
FIGS. 9A, 10, 11, 12A and 13 illustrate a schematic of a top view wherein the workpiece is being used to form restrictive tooling in accordance with the subject invention.

Directing attention to FIG. 9A, by enlarging the amplitude of the translation about the orbital polishing machine axis 77, the workpiece 20 physically contacts a blank 110 and may be used to remove material, thereby forming a desired shape for the restrictive tooling 30. This enlarged amplitude is illustrated by "A" and defines a circular path 107.

By longitudinally plunging the workpiece 20 along the axis 77 into the blank 110, the cavity 60 necessary for restrictive tooling compatible with that workpiece 20 is formed from the blank 110. Those same motions, as previously discussed in FIGS. 4A–8, are duplicated. However, now the amplitude of the workpiece translation is increased from offset distance "d" to offset distance "A", thereby eliminating the gap between the workpiece 20 and the cavity 60 of the restrictive tooling 30. This is no longer an abrasion process using an intermediate media but now a material removal process occurs since the workpiece 20 is actually being used to remove material from the blank 110.

Although not illustrated in FIG. 9A, it should be appreciated that initially the workpiece 20 is vertically separated from the blank 110 to be converted into restrictive tooling by being physically distanced along the longitudinal axis 77. As the orbital polishing machine is activated, the workpiece 20 begins its motion about circular path 107 and, at the same time, is plunged into the blank 110 which will become the restrictive tooling. As the workpiece 20 completes its travel around the circular path 107, each of the walls 65*a*–65*d* of the blank 110 are defined by the walls 45*a*–45*d* of the workpiece 20, as illustrated in FIGS. 9A–13 with motion indicated in the direction of arrows 115, 120, 125, 130, and 135, respectively.

Figure 10:
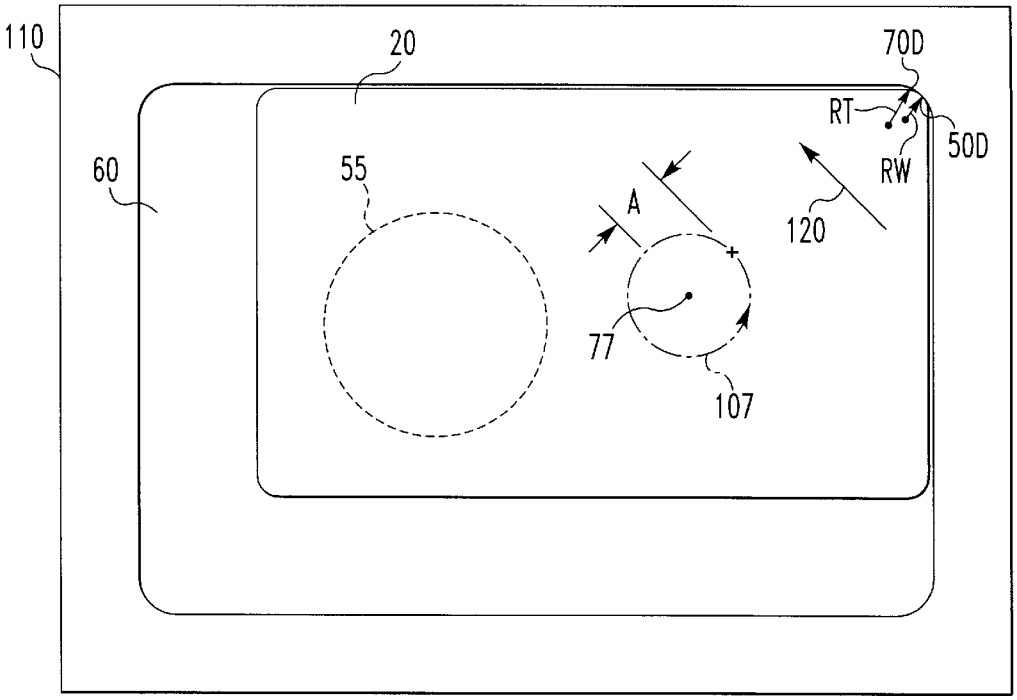
Figure 11:
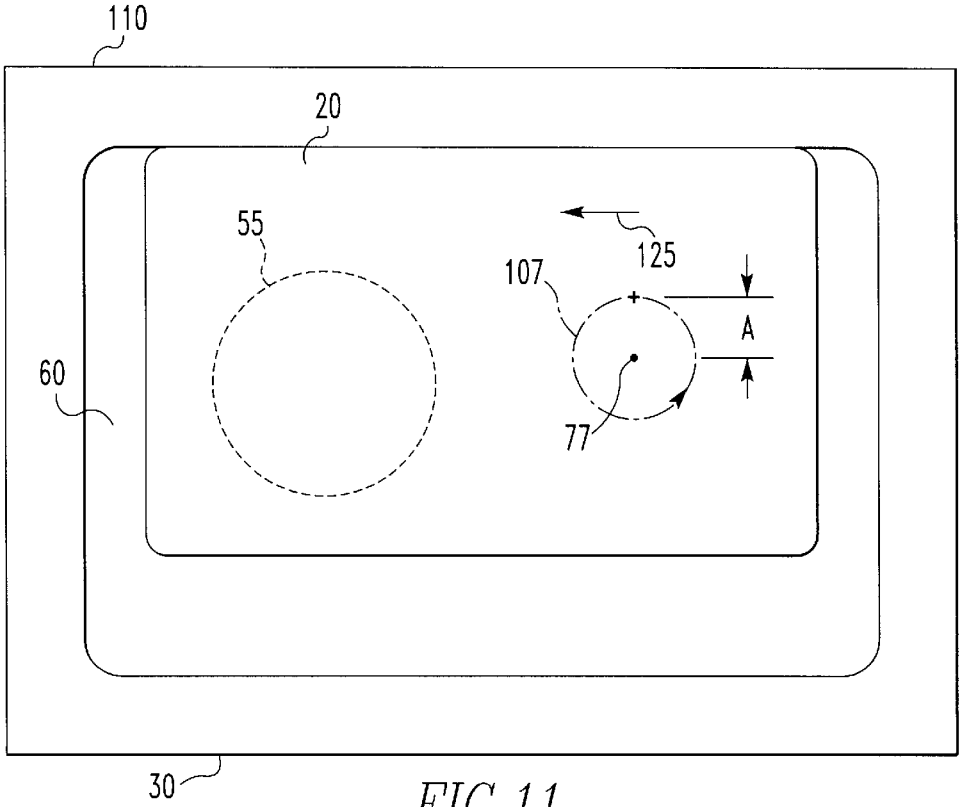
Figure 12A:
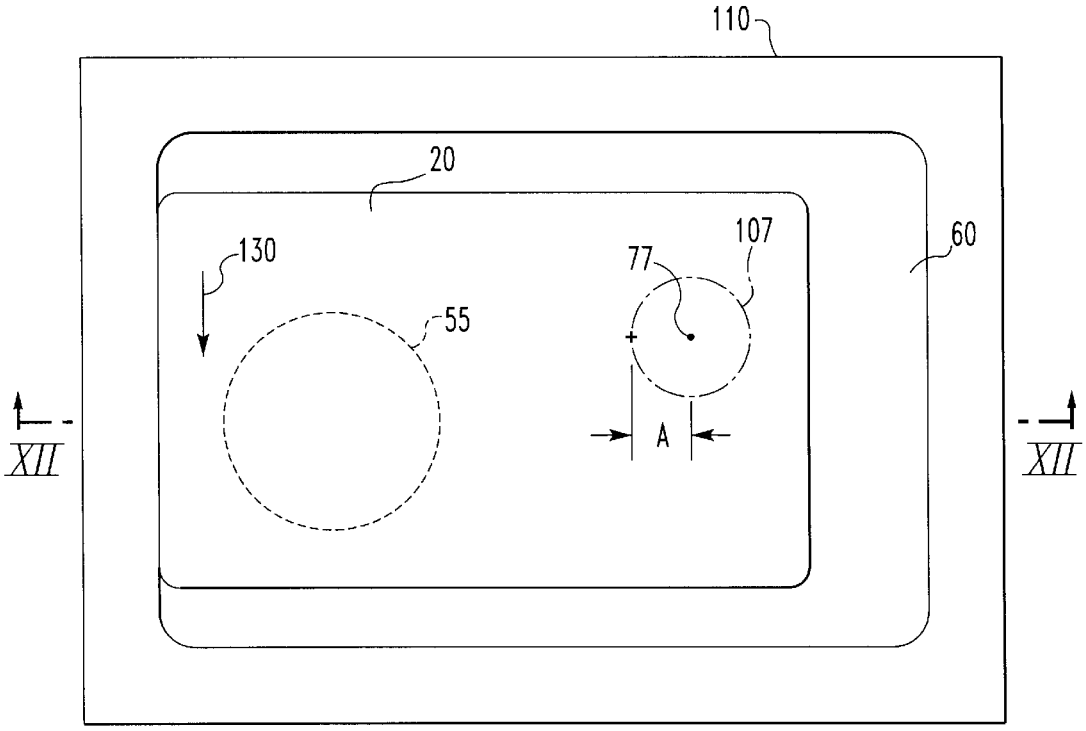
Figure 12B:
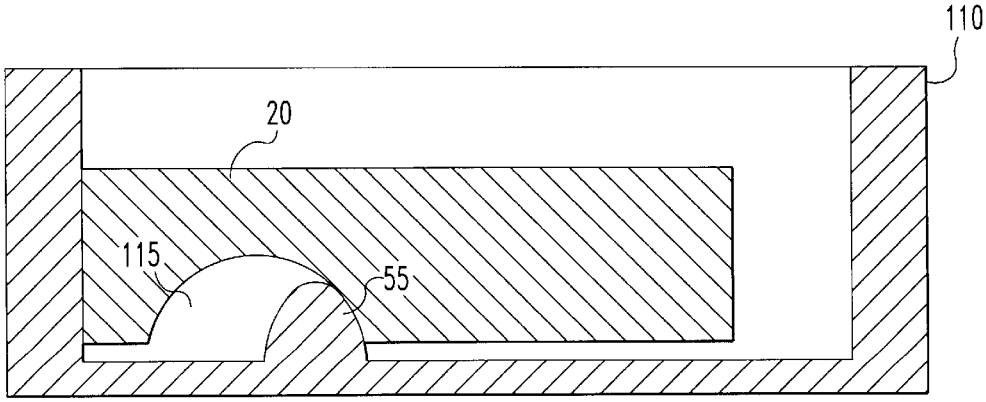
Figure 13:
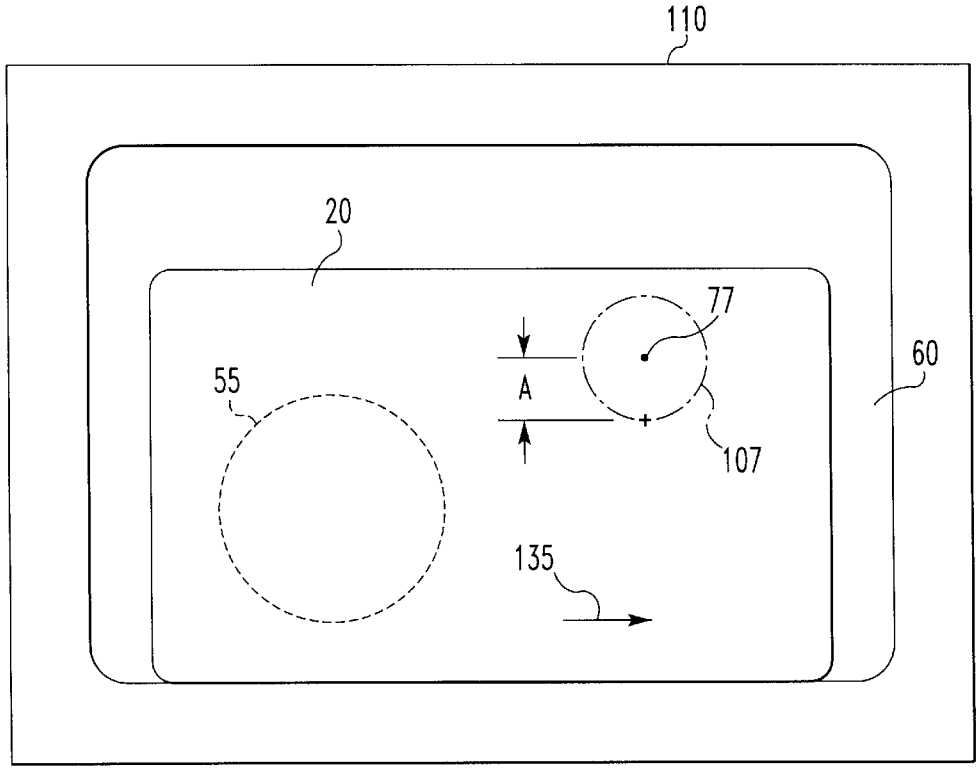

With particular attention to FIG. 10, corner 50*d* of the workpiece 20 will be used to generate an associated corner 70*d* of the blank 110 to form restrictive tooling. The radius RT of the corner 70*d* of the restrictive tooling 30 will be greater than the radius RW of the corner 50*d* by the amount of amplitude represented by offset distance "A".

Figure 9B:
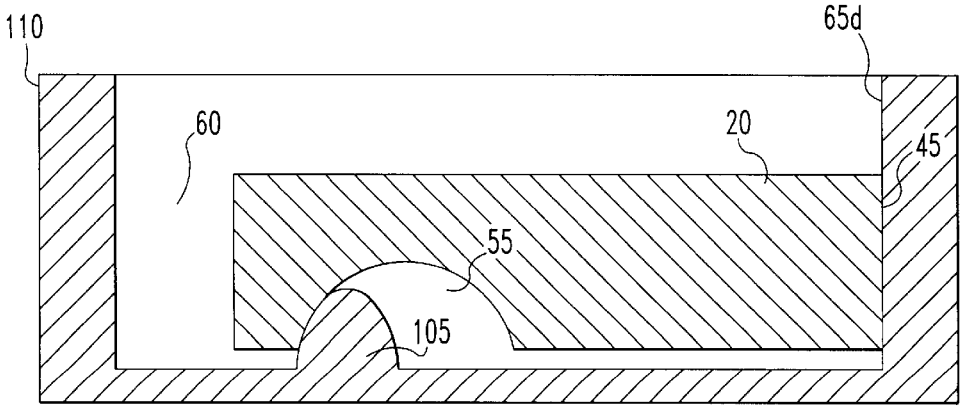
FIGS. 9B and 12B illustrate cross-sectional side views along arrows IX—IX and XII—XII as illustrated in FIGS. 9A and 12A, respectively.

With reference to FIGS. 9A and 9B, the same concept applies to the recess 55 of the workpiece 20 and the projection 105 in the blank 110. The projection 105 of the blank 110 is reduced in size and shape from that of the recess 55 of the workpiece 20. The radius of the protrusion 105 will be a value greater than that of the recess 55 at selected points by an amount equal to the amplitude A. Therefore, the outwardly extending surfaces 45*a*–45*d* and 50*a*–50*d* on the workpiece 20 produce proportionately enlarged inwardly extending surfaces 65*a*–65*d* and 70*a*–70*d* on the blank 110 while inwardly extending surfaces, such as recess 55 on the workpiece 20, produce proportionately reduced outwardly extending surfaces such as protrusion 105 on the blank 110.

Put in perspective, the workpiece 20 is used as a shaping device to form from blank 110 the cavity 60 associated with the restrictive tooling 30. However, the size of the restrictive tooling cavity 60 must be greater than the outer perimeter of the workpiece 20 to permit the introduction of media 35 between the two, thereby ensuring relative motion between the workpiece 20 and the restrictive tooling 30 will result in polishing of the workpiece 20. For this reason, the workpiece 20 is moved about a circular path 107 having an amplitude of translation A with a value greater than the amplitude of translation d associated with the circular path 80 used in the actual orbital polishing process. The gap created between the restrictive tooling 30 and the workpiece 20 will be the difference between amplitude A and amplitude d.

The workpiece 20 is now moved completely around circular path 107 and contacts the blank 110 until a cavity 60 is imparted within the blank 110 to form the restrictive tooling 30. This range of motion is further illustrated in FIGS. 10, 11, 12A, 12B, and 13.

Figure 14:
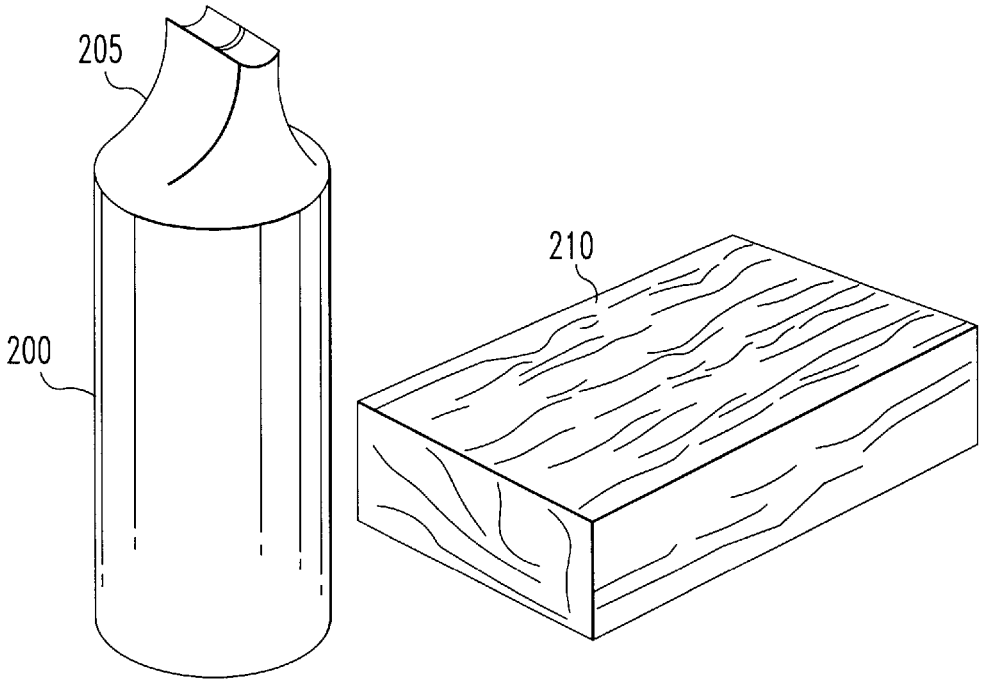
FIGS. 14–16 illustrate one example of a workpiece utilized to produce restrictive tooling in a blank in accordance with the subject invention.

FIG. 14 illustrates a workpiece 200 having an end portion 205 for which matching restrictive tooling is desired to be produced upon a blank 210.

Figure 15:
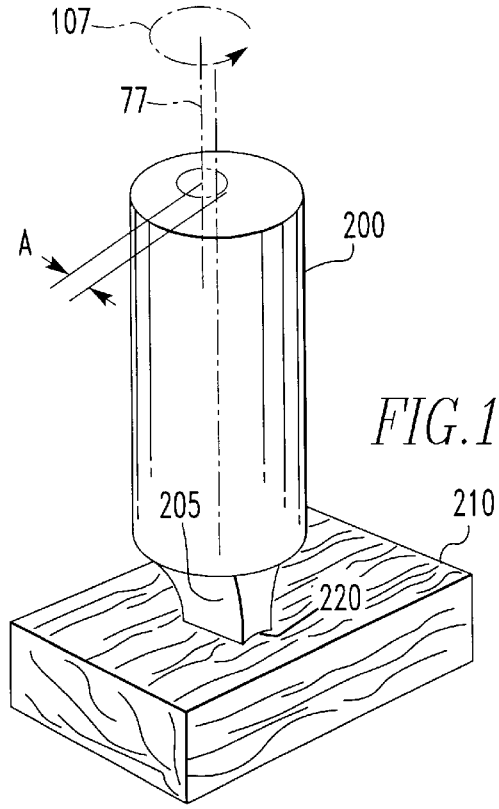
Figure 16:
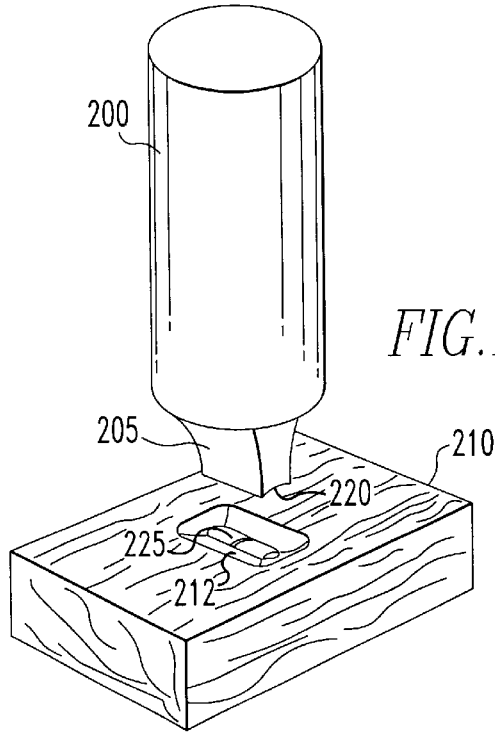

Directing attention to FIGS. 15 and 16, the workpiece 200 is introduced into the blank 210 by being axially fed along the axis 77 of the orbital polishing machine 10 while at the same time being translated about the circular path 107 with an amplitude of translation A. The translational motion of the workpiece 200 acts to abrade the surface of the blank 210 and to impart within the blank 210 a cavity 212 having the same general topographical surface features as that of the end portion 205 of the workpiece 200. However, as a result of the translation of the workpiece 200, the cavity will, for the most part, be oversized but proportional to the shape of the end portion 205 of the workpiece 200. It should be noted that concave surfaces, such as 220 on the workpiece 200, will impart to the blank 210 a convex surface 225 having a smaller profile than the concave surface 220. Furthermore, the amplitude of translation A to which the workpiece 200 is subjected is limited by such concave surfaces 220 because if the amplitude is too great, the associated convex surface 225 would be eliminated.

A method has now been described for producing restrictive tooling from a blank for use in an orbital polishing machine with a workpiece mounted thereon and having a particular contour comprising the step of urging one of either the workpiece or the blank along a predetermined path against the other to physically impart a proportioned contour of the workpiece into the blank, thereby producing the restrictive tooling. As discussed, the outwardly extending surfaces of the workpiece produce a proportionately enlarged inwardly extending surface on the blank, and the inwardly extending surfaces of the workpiece produce a proportionately reduced outwardly extending surface on the blank.

While the motion between the workpiece and the restrictive tooling has been described as translational about a circle, it should be appreciated that it is necessary only for the motion to be oscillatory between the workpiece and the blank. This oscillatory motion may be comprised of orbital, gyrating, linear, or reciprocating motion.

In order for the workpiece 200 to impart its shape into the blank 210, it is necessary for the workpiece to have a greater hardness than the tooling blank. Typically, workpieces are made of material such as steel or aluminum and, therefore, the tooling blank may be comprised of a material such as wood. Particular wood may include pine or oak. However, it has been found that wood is a preferable material because the abrasive media tends to adhere to the surface of the wood, thereby promoting abrasive motion between the media and the workpiece.

Therefore, the blank, which may be wood, may have a value of porosity that will promote adhesion between the media and the restrictive tooling that will be formed from the blank. Ideally, the media will adhere completely to the restrictive tooling such that there is no relative sliding motion between the media and the restrictive tooling.

The blank may also have a roughness that may promote engagement of the blank with the media. However, since the blank will be shaped into restrictive tooling, the roughness of the blank must not be so great that the roughness contour of the subsequently produced restrictive tooling is imparted to the workpiece.

Additionally, the blank may possess a level of toughness that provides superior wear resistance to promote the longevity of the subsequently produced restrictive tooling.

Although wood has been discussed as material for a blank, the material may be of any of a number of other materials, such as, but not limited to, nylon or a two-part system made up of resin and a hardener mixed together and cured to form a solid.

It is entirely possible after the blank has been formed into the restrictive tooling that a coating of protective material may be applied. However, it is preferred that if such a material were applied to the restrictive tooling, that material should possess similar properties to those previously discussed which would promote the adhesion and retention of the media against the restrictive tooling.

In the past, as previously mentioned, restrictive tooling was constructed by conventional machining methods or by castings. This required fabricating the restrictive tooling at one station and then transferring and securing the restrictive tooling to the orbital polishing machine at another station. The restrictive tooling had to be precisely positioned within the orbital polishing machine prior to use.

Advantageously, it is possible to use the same orbital polishing machine to both produce the restrictive tooling from a blank using a workpiece and then to use the newly produced restrictive tooling to polish the same workpiece. By doing so, not only is the transfer operation eliminated but the task of precisely positioning the restrictive tooling within the polishing machine is also eliminated. As a result, the restrictive tooling fabrication process is greatly simplified. Therefore, this in situ process, by utilizing the same orbital polishing machine to both construct the restrictive tooling and then engage the restrictive tooling to polish the same workpiece, saves time and eliminates the need for two separate stations to construct and employ the restrictive tooling. This simplifies the process for producing restrictive tooling and subsequently using that tooling to polish a workpiece.

As an example, and specifically with reference to the apparatus in FIGS. 17A–17D, the workpiece 200, having an end portion 205, may be mounted upon a first platen 230 of an orbital polishing machine 10. The blank 210 made of a softer material than that of the workpiece 200 may then be mounted upon an opposing second platen 235 of the orbital polishing machine 10. The orbital polishing machine 10 may then be energized to produce relative motion between the workpiece 200 and the blank 210.

Figure 17A:
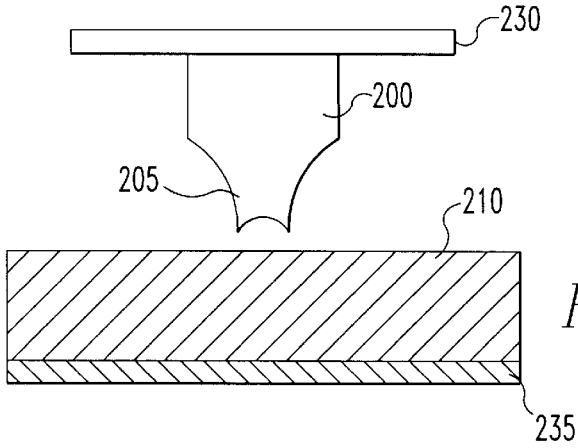
FIGS. 17A–17D illustrate schematic drawings of a method of producing restrictive tooling and using that tooling for polishing on the same orbital grinding machine in accordance with the subject invention.
Figure 17B:
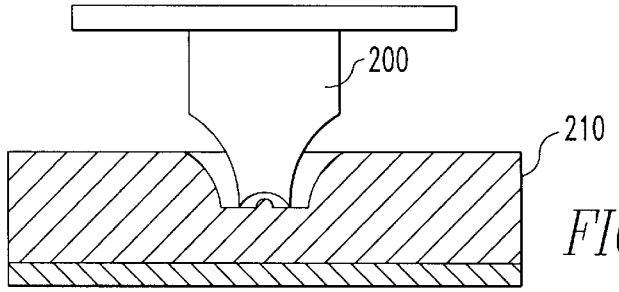
Figure 17C:
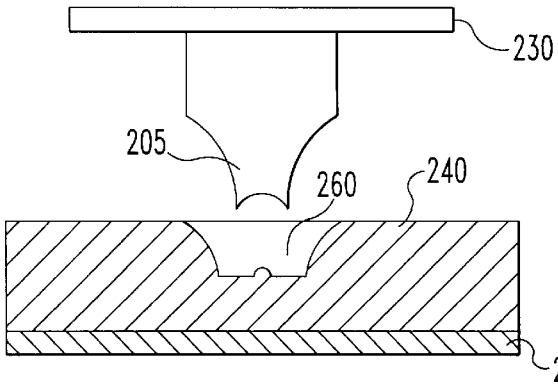
Figure 17D:
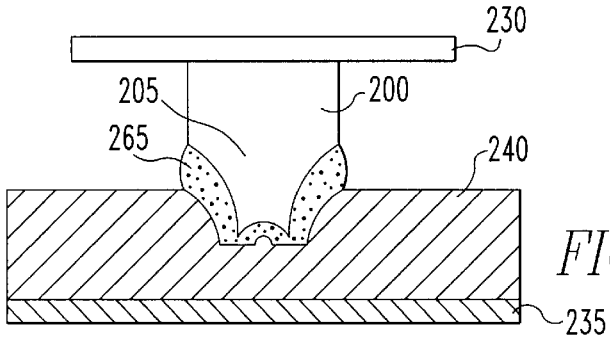

Unlike in FIG. 1, the first platen 230 and the second platen 235 may be advanced toward each other (FIG. 17B) until the workpiece 200 penetrates the blank 210 to a predetermined depth. With a relative motion between the workpiece 200 and the blank 210, the workpiece 200 will abrade the surface of the blank 210 to form the shape of the end portion 205 of the workpiece 200 illustrated in FIG. 16. At this point, the first platen 230 and second platen 235 may be retracted from each other to reveal restrictive tooling 240 having a cavity 260 which approximates the shape of the end portion 205 of the workpiece 200 (FIG. 17C). To the extent any residual material remains upon the restrictive tooling 240, it may be removed. The restrictive tooling 240, if it has been removed, may be mounted in the second platen 235 in the same way it was originally secured and now media 265 may be introduced between the restrictive tooling 240 and the workpiece 200 (FIG. 17D). At this point, the orbital polishing process may be initiated and the workpiece 200 polished using a high quality restrictive tooling 240 that was generated by the workpiece 200 itself.

So far, the discussion has been directed to the use of a solid blank which is essentially machined by the workpiece. In many circumstances, this method is very effective and produces restrictive tooling of superior quality. However, depending upon the size and durability of the workpiece, it may not be desirable to form the restrictive tooling from a solid blank. As one example, if a workpiece has a large surface area and is urged against a block of wood to form restrictive tooling, it is possible that friction and the associated heat generated between the workpiece and the blank may deform the shape of the workpiece.

As an alternative, a liquid or semi-liquid may be used as a soft blank that, while shaping, cures into a solid or otherwise solidifies. Using a liquid or semi-solid composition that cures to a solid or otherwise solidifies, it is possible to form the restrictive tooling before it becomes solid with minimal friction between the workpiece and blank.

One composition, a two-part liquid system polyurethane epoxy, such as the polyurethane reactive adhesive manufactured by Ciba-Geigy and identified by the trademark PurFect Tool®, may be used and formed into restrictive tooling while it is curing.

Figure 18A:
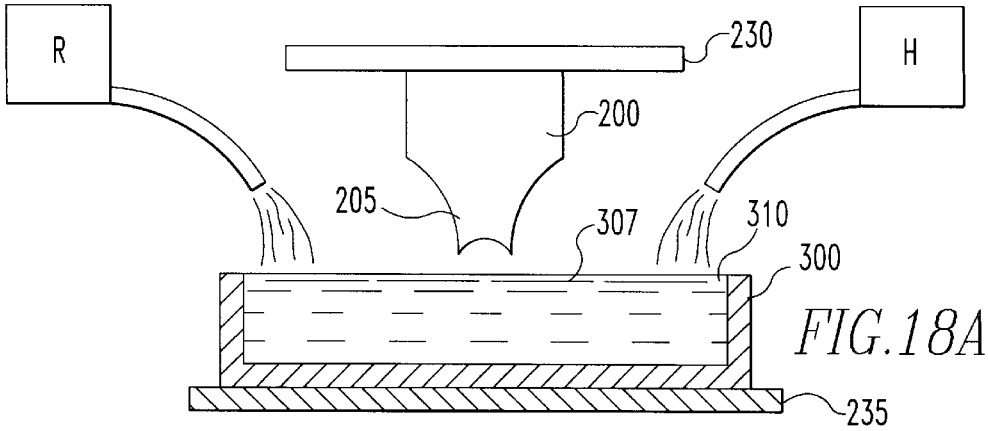
FIGS. 18A–18E illustrate schematic drawings of a method of producing restrictive tooling using a liquid or semi-solid material as the blank and then using the restrictive tooling for polishing on the same orbital polishing machine in accordance with the subject invention.
Figure 18B:
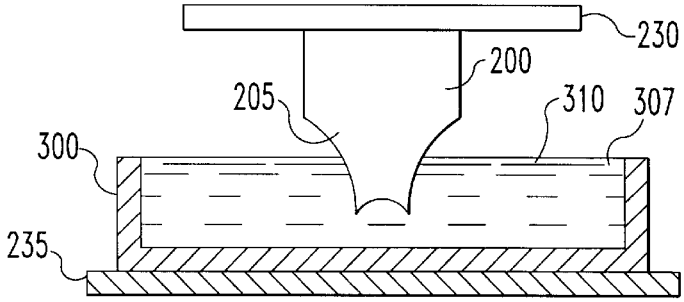

Directing attention to FIGS. 18A–18E, just as with the apparatus illustrated in FIGS. 17A–17D, the workpiece 200 may be mounted upon a first platen 230 of an orbital polishing machine. However, instead of using a solid blank, illustrated in FIG. 18A is a two-part liquid system such as polyurethane epoxy comprised of a resin R and a hardener H used to fill a vessel 300 with a liquid solution 307 to provide a soft blank 310 that will cure and harden over time. The vessel 300 may be mounted upon the second platen 235. As illustrated in FIG. 18B, the first platen 230 and the second platen 235 are advanced toward each other until the workpiece 200 penetrates the liquid solution 307 to a predetermined depth. Typically, this depth will conform to the actual depth of the desired restrictive tooling.

Figure 18C:
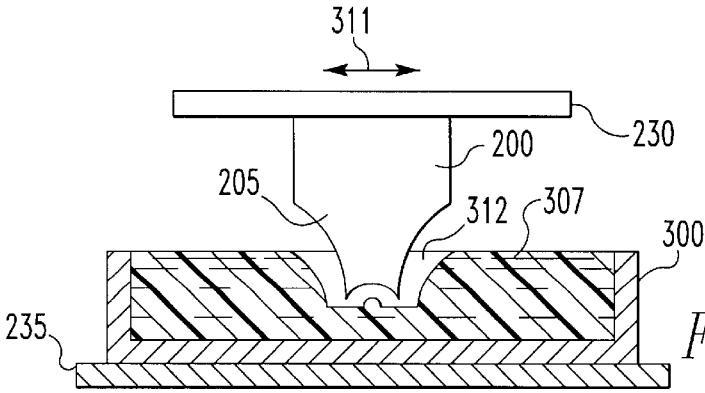

With the relative motion between the workpiece 200 and the vessel 300, indicated by arrow 311, the workpiece 200 will move within the liquid solution 307 to create a void while the liquid solution 307 cures and hardens. This void will define a cavity 312, as illustrated in FIG. 18C, which has the shape of the end portion 205 of the workpiece 200. The relative motion between the workpiece 200 and the liquid solution 307 continues until the liquid solution 307 has cured enough to retain the shape of the cavity 312.

Figure 18D:
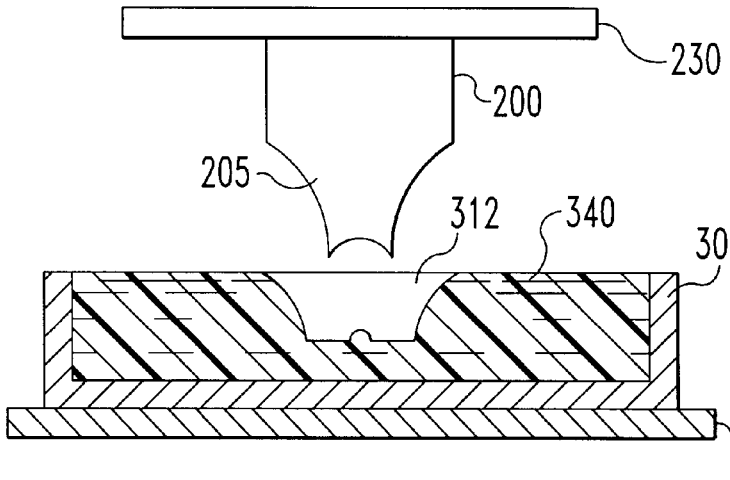

At this point, as illustrated in FIG. 18D, the first platen 230 and the second platen 235 may be retracted from each other to reveal the solidified liquid solution, which has now become the restrictive tooling 340, having a cavity 312 which approximates the shape of the end portion 205 of the workpiece 200. To the extent any residual material remains upon the restrictive tooling 340, it may be removed.

Figure 18E:
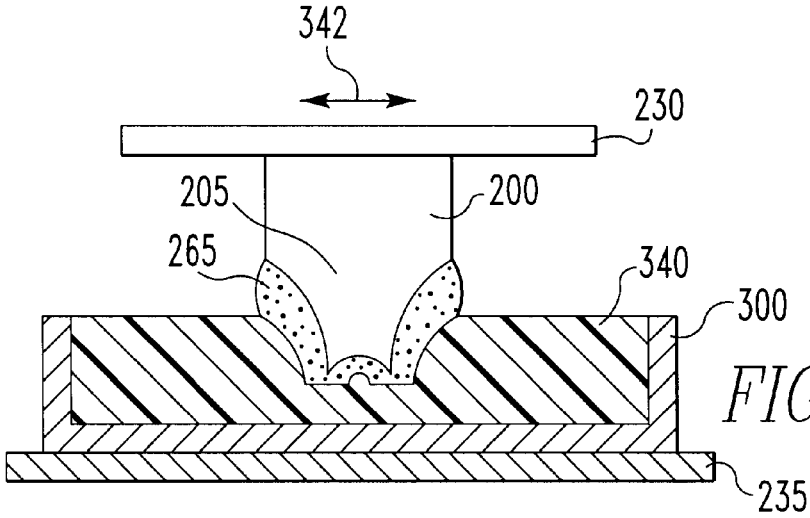

As illustrated in FIG. 18E, an abrasive media 365 may now be introduced between the restrictive tooling 340 and the workpiece 200, and the orbital polishing process may be initiated as indicated by arrow 342, thereby polishing the workpiece 200 using a high quality restrictive tooling 340 that was generated by the workpiece 200 itself.

A process has been defined whereby, using a single orbital polishing machine, it is possible to produce restrictive tooling using a workpiece and then to subsequently polish that workpiece using the same restrictive tooling.

It should be appreciated that while FIGS. 17A–17D and 18A–18E illustrate the production of restrictive tooling utilizing a single orbital polishing machine, it is entirely possible to produce such restrictive tooling on one orbital polishing machine, which may be dedicated to such an activity, and then to transfer such restrictive tooling to another orbital polishing machine to perform the polishing operation upon a workpiece.

One limitation of producing restrictive tooling from a solid blank is the inability in instances where the workpiece has an undercut, to effectively duplicate the undercut with the restrictive tooling. Another advantage, therefore, of using a liquid or semi-solid as a soft blank that cures to a hardened solid is the ability to form restrictive tooling compatible with such a workpiece.

Figure 19A:
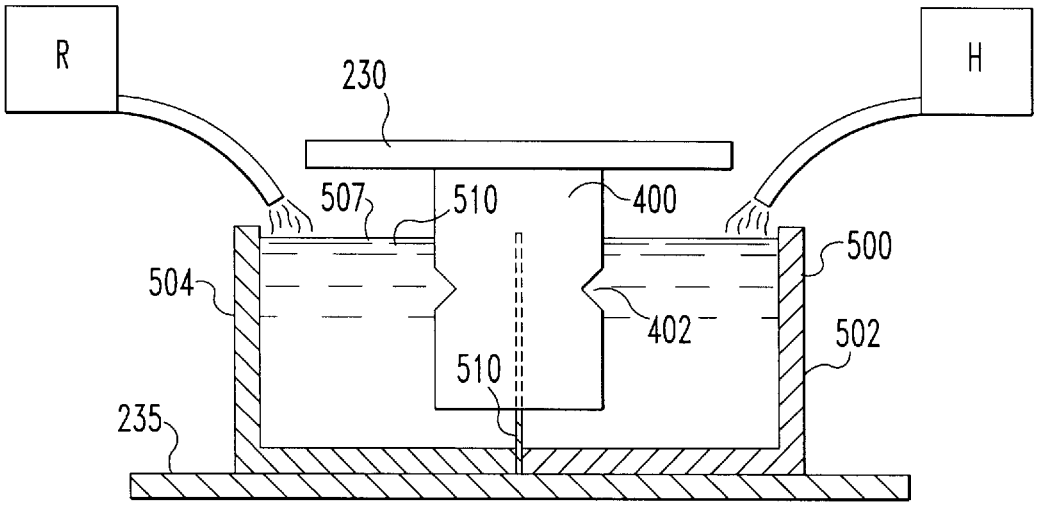
FIGS. 19A–19E illustrate schematic drawings of a method of producing restrictive tooling having an undercut using a liquid or semi-solid material as the blank and then using the restrictive tooling for polishing on the same orbital polishing machine in accordance with the subject invention.
Figure 19B:
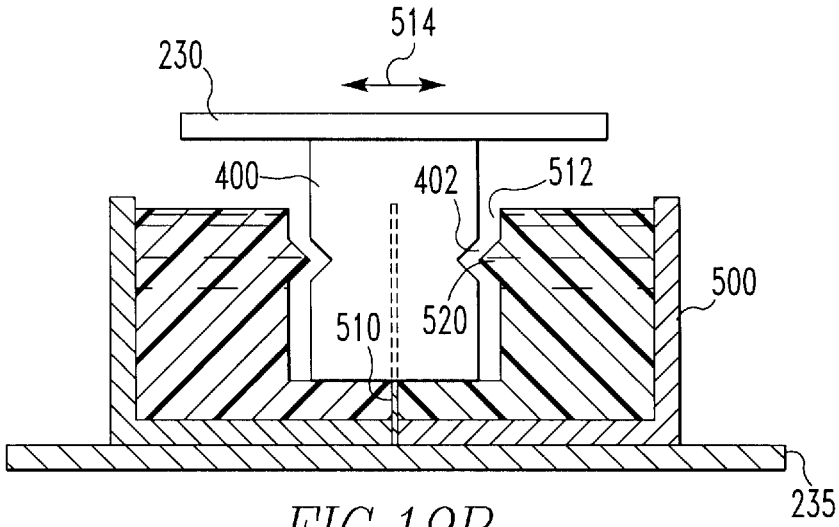
Figure 19C:
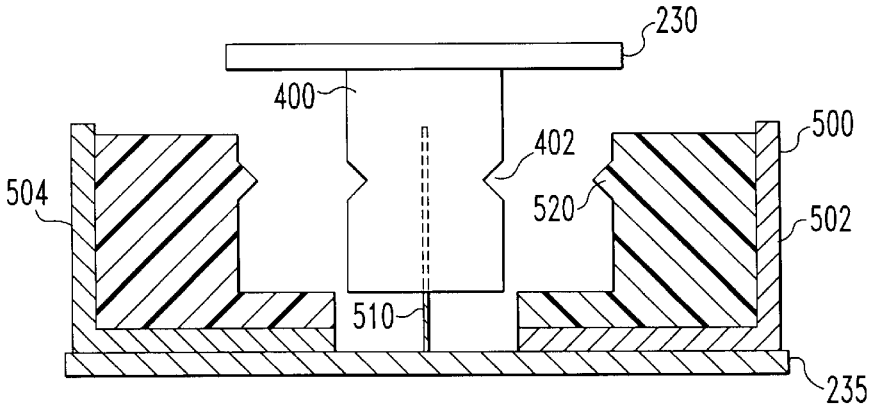
Figure 19D:
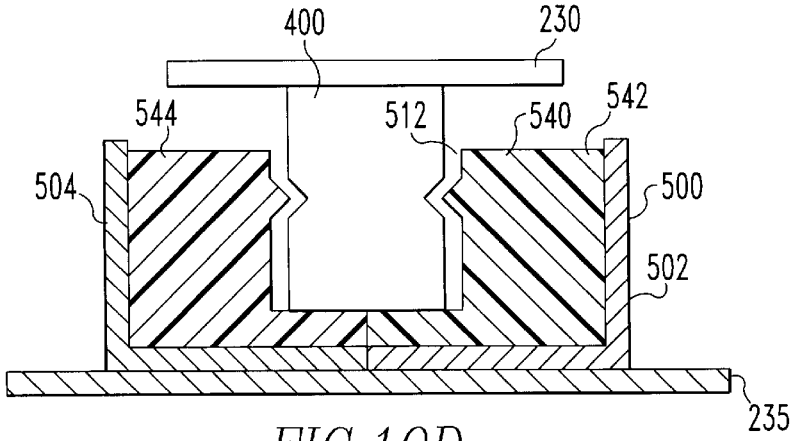
Figure 19E:
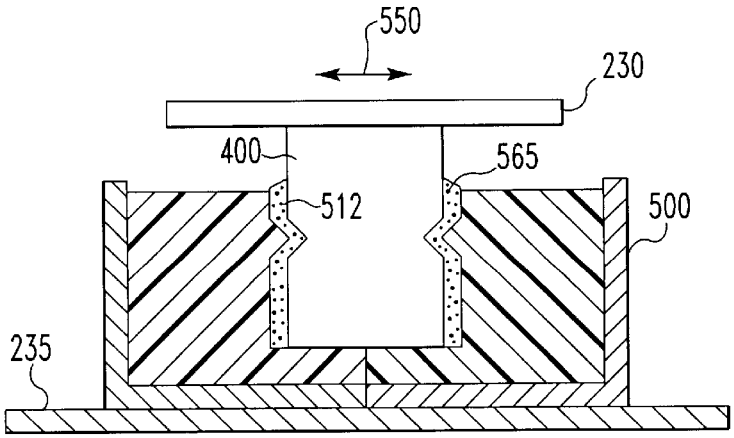
Figure 20:
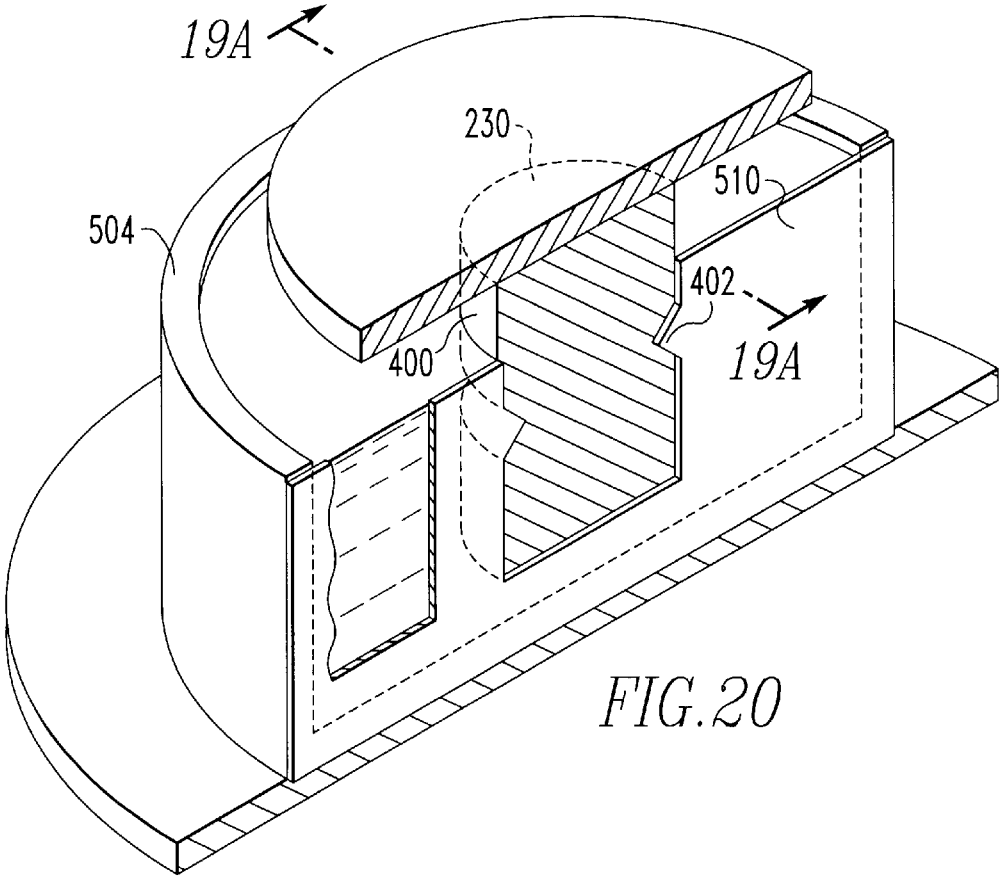
FIG. 20 illustrates a partial isometric view of one arrangement used to accomplish the method described in FIGS. 19A–19E.

Directing attention to FIGS. 19A–19E and to FIG. 20, a workpiece 400 may be mounted upon a first platen 230 of an orbital polishing machine 10. However, just as illustrated in FIGS. 18A–18E, instead of using a solid blank, a two-part liquid system polyurethane epoxy comprised of a resin R and a hardener H may be used to fill a vessel 500 with a liquid solution 507 to provide a soft blank 511 that will cure and harden over time.

As illustrated in FIG. 20, the workpiece 400 has an undercut 402. It should be noted that the schematic drawings of FIGS. 19A–19E are views taken from the position indicated by arrows XIX—XIX in FIG. 20.

As illustrated in FIG. 19A, the first platen 230 and the second platen 235 are positioned relative to one another such that the workpiece 400 penetrates the volume defined by the vessel 500, which is split and defined by a first half 502 and a second half 504 secured to one another. A two-part liquid system, such as polyurethane epoxy comprised of a resin R and a hardener H, is used to fill the vessel 500 with a liquid solution 507 to provide a soft blank 511 that will cure and harden over time. To promote separation between the first half 502 and the second half 504 of the vessel 500, which may be necessary to remove the workpiece 400 from the soft blank 511 when it hardens, a divider sheet 510 (FIG. 20), which is a cut-out conforming to the shape of the workpiece 400, is secured to the workpiece 400 using, for example, epoxy or clay and is furthermore secured to the vessel 500, again using epoxy or clay or, on the other hand, by clamping the ends of the divider sheet 510 between the two halves 502, 504 of the vessel 500. The two halves, 502, 504 of the vessel 500 may be clamped together. However, as a result of the divider sheet 510, the vessel 500 is divided into two isolated compartments and, therefore, the two-part liquid system must be introduced separately into each compartment. FIG. 19A illustrates a schematic whereby the two-part liquid system has been introduced into the first half 502 and the second half 504 of the vessel 500, separated by the divider sheet 510.

As illustrated in FIG. 19B, the first platen 230 and the second platen 235 are subjected to relative motion to produce relative motion between the workpiece 400 and the vessel 500. The workpiece 400 moves within the liquid solution 507 to create a void, while the liquid solution 507 cures and hardens. This void will define a cavity 512, as illustrated in FIG. 19B, which has the shape of the workpiece 400. The relative motion between the workpiece 400 and the liquid solution 507, indicated by arrow 514, continues until the liquid solution 507 has cured enough to retain the shape of the cavity 512. This will produce restrictive tooling 540 having a first half 542 and a second half 544. At this point, if the depth of the undercut 402 is sufficiently small relative to the amplitude of oscillation, then there may be sufficient clearance between the undercut 402 and the newly produced protrusion 520. If this is the case, the workpiece 400 may be vertically withdrawn from the cavity 512. However, it is more likely that the depth of the undercut 402 is larger than the amplitude of oscillation, thereby producing an arrangement whereby the protrusion 520 extends partially into the undercut 402 and retains the workpiece 400 within the cavity 512.

Under these circumstances, as illustrated in FIG. 19C, the first half 502 and the second half 504 of the vessel 500, along with the first half 542 and the second half 544 of the restrictive tooling 540, must be pulled apart thereby exposing the workpiece 400. The workpiece 400 may now be withdrawn from the cavity 512 and the restrictive tooling 540 may be used to polish this workpiece 400 or other workpieces. As illustrated in FIG. 19C, the liquid solution has solidified to become what is now the restrictive tooling 540, having a cavity 512, which approximates the shape of the workpiece 400. To the extent any residual material remains upon the restrictive tooling 540, it may be removed.

As illustrated in FIG. 19D, it is now possible to assemble the first half 542 with the second half 544 of the restrictive tooling 540, with or without the vessel 500, about a workpiece 400 and, as illustrated in FIG. 19E, to fill the cavity 512 with an abrasive media 565. The orbital polishing process may then be initiated, as indicated by arrow 550, thereby polishing the workpiece 400 using a high-quality restrictive tooling 540 that was generated by the workpiece 400 itself.

The divider sheet 510 may be made of a thin Mylar® sheet, having sufficient flexibility to avoid displacing the liquid solution 507 while it is curing. Additionally, the divider sheet 510 may be coated with a mold-releasing agent, such that once the liquid solution 507 has cured, the two halves 542, 544 of the restrictive tooling 540 may be separated from one another.

While the exemplary undercut 402 in the workpiece 400 is V-shaped, it is entirely possible for this undercut to have a different shape. For example, the undercut 402 may be a rectangular notch having parallel faces. Under these circumstances, to avoid the undercut 402 binding with the protrusion 520 created in the restrictive tooling 540, the workpiece 400 may be oscillated laterally, as illustrated in FIG. 19B, but may also then be separately oscillated in a vertical direction, thereby providing a protrusion 520 having a thickness less than that of the actual shape of the undercut 402, however, possessing the requisite clearance to avoid binding.

In some situations, it may be desirable to utilize a blank of very soft material, contour the blank, and use the contoured blank as a mold to create restrictive tooling made of another, more durable material. There are several characteristics of the workpiece which warrant the use of this "indirect" method of forming the restrictive tooling. These characteristics include the fragility or detail of the workpiece, the depth of the cavity, and the surface area of the cavity. Fine details of the workpiece may fracture if the workpiece is used to form a cavity in a blank of a relatively hard material, such as wood. Furthermore, a wood blank, when contacted by the workpiece to form a cavity, may heat up or burn if the pattern of the workpiece includes a broad surface area.

Directing attention to FIGS. 21A–21G, a workpiece 200, supported by a first platen 230, is positioned adjacent to a blank 610 supported by a second platen 635. In a manner as previously described, the workpiece 200 is urged against the blank 610 along a predetermined path to physically impart a proportioned contour of the workpiece 200 into the blank 610, thereby forming a contoured blank 615, illustrated in FIG. 21B. However, as previously described, the contoured blank 615 would be used as restrictive tooling to polish the same workpiece 200. Using an indirect method, the contoured blank 615 illustrated in FIG. 21B may then be used as a pattern to produce a first mold, and the first mold may then be used as a pattern to produce a second mold having a shape identical to the contoured blank 615.

Figure 21A:
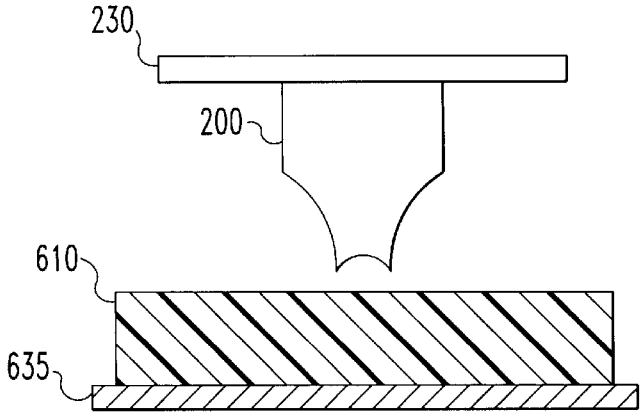
FIGS. 21A–21G illustrate schematic drawings of a method of producing restrictive tooling utilizing a blank to produce a first mold and using the first mold to produce a second mold, which may be utilized as restrictive tooling, in accordance with the subject invention.
Figure 21B:
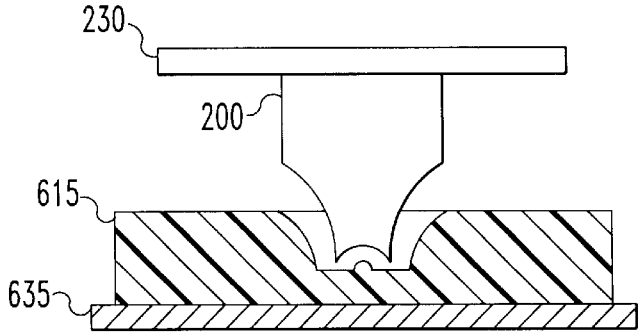
Figure 21C:
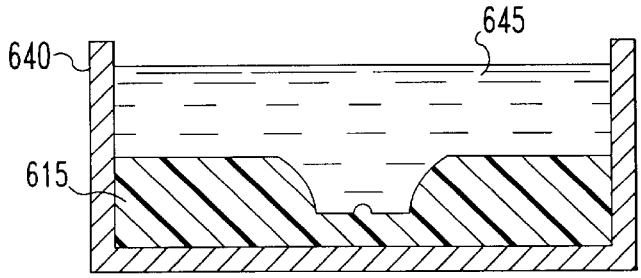

Directing attention to FIG. 21C, a sleeve 640 is placed around the contoured blank 615 and a molding liquid 645 is poured into the volume within the sleeve 640 above the level of the contoured blank 615. It should be noted that the sleeve 640 may also be an enclosed vessel into which the contoured blank 615 fits relatively tightly.

The molding liquid 645 conforms to the external surface of the contoured blank 615. The molding liquid may be comprised of a thermally curable epoxy or a two-part curable epoxy or any other material typically utilized that is pourable and would harden to form an acceptable mold.

Figure 21D:
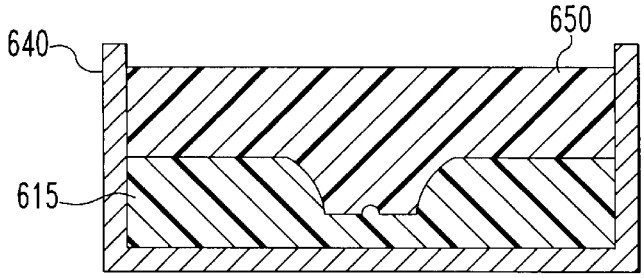
Figure 21E:
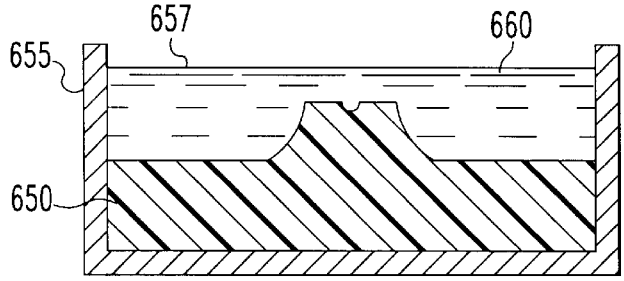

FIG. 21D illustrates a first molded body 650, which was produced using the contoured blank 615 as a pattern and is the molding liquid 645 cured to be solid. The first molded body 650 is a negative image of the contoured blank 615.

Figure 21F:
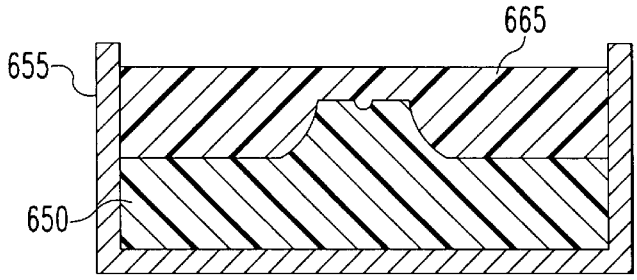

Directing attention to FIG. 21F, the first molded body 650 is removed from the sleeve 640, inverted, and surrounded by a sleeve 655, which defines a volume 657 suitable to receive a molding liquid 660. Just as before, the molding liquid may be a thermally curable epoxy or a two-part curable epoxy or any other pourable liquid suitable for the formation of molds. However, as will be seen, the product generated from the molding liquid 660 must have suitable hardness and durability to act as restrictive tooling.

Figure 21G:
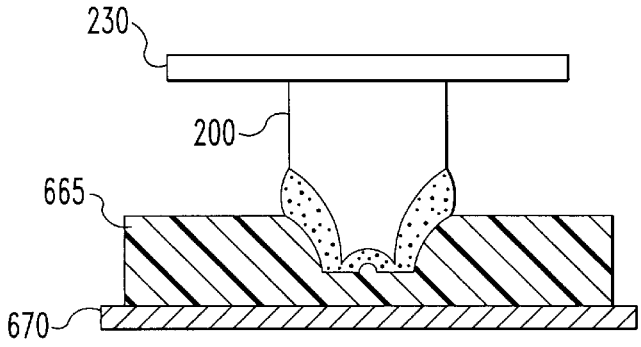

The molding liquid 660 is poured within the volume 657 defined by the sleeve 655 to conform to the exposed contour of the first molded body 650. The molding liquid 660 hardens to form a second molded body 665, using the first molded body 650 as a pattern, as illustrated in FIG. 21G. The second molded body 665 is a negative image of the first molded body 650 and duplicates the shape of the contoured blank 615, such that the second molded body 665 may be used as the restrictive tooling.

Just as before, the workpiece 200 should have a lower hardness than the restrictive tooling. The first molded body 650 may be made of a material having a lower hardness than the material of the second molded body 665. Furthermore, the second molded body 665 may be made of a material having a hardness greater than the hardness of the blank 610, so that such hardness is sufficient to allow the second molded body 665 to function as the restrictive tooling. The material of the blank 610 suitable for use with this indirect method may be one comprised of styrofoam, wax, plaster, or plastic.

As illustrated in FIG. 21G, the second molded body 665 may be secured to a second platen 670 and utilized as a restrictive tooling for polishing the workpiece 200 secured by a first platen 230. By utilizing this method, it is entirely possible to produce restrictive tooling for a workpiece having a relatively soft material, wherein the workpiece may be damaged or warped by contact or rubbing with a blank of another material.

Although only certain shapes of workpieces have been disclosed in this application, it should be appreciated that the limitations on the application of this method to produce restrictive tooling is unlimited and a multitude of other shapes for restrictive tooling is possible.

Throughout this discussion, translation along a circular path has been discussed, however, it should again be appreciated that oscillatory motion in any direction would be suitable to produce restrictive tooling associated with a given workpiece with the understanding that the same pattern of motion implemented during the orbital abrasive polishing process may be implemented by the workpiece to generate the restrictive tooling.

Throughout this discussion, relative motion between the workpiece and the restrictive tooling and/or the blank has been discussed. Such relative motion may be produced by moving either or both the workpiece and the restrictive tooling and/or the blank.

The invention has been described with reference to the preferred embodiment. Obvious modifications and alterations will occur to others upon reading and understanding the preceding detailed description. It is intended that the invention be construed as including all such modifications and alterations insofar as they come within the scope of the appended claims or the equivalents thereof.

We claim:

1. A method for producing, from a blank, restrictive tooling or a pattern or mold from which to produce restrictive tooling for use with a flowable abrasive media upon a workpiece in an orbital polishing machine wherein the workpiece has a particular contour, the method comprising the steps of:

a) urging one of either the workpiece or the blank along a predetermined path against the other to physically impart a proportioned contour of the workpiece into the blank, thereby producing the restrictive tooling, pattern or mold within the blank to form a contoured blank and b) using the contoured blank produced by the workpiece to polish the workpiece with flowable abrasive media or to produce a part that will polish the workpiece with flowable abrasive media.

2. The method according to claim 1, wherein outwardly extending surfaces of the workpiece produce proportionately enlarged inwardly extending surfaces on the blank and inwardly extending surfaces of the workpiece produce proportionately reduced outwardly extending surfaces on the blank.

3. The method according to claim 1, wherein the step of urging the workpiece against the blank is comprised of imparting oscillatory motion between the workpiece and the blank.

4. The method according to claim 3, wherein the oscillatory motion may be comprised of one from the group of orbital, translational, gyrating, linear or reciprocating motion.

5. The method according to claim 3, wherein the amplitude of the oscillatory motion is between approximately 0.1 mm (0.004 inches) and approximately 10.0 mm (0.394 inches).

6. The method according to claim 5, wherein the amplitude of the oscillatory motion is between approximately 0.5 mm (0.020 inches) and approximately 6.0 mm (0.236 inches).

7. The method according to claim 1, wherein the workpiece has a greater hardness than the blank.

8. The method according to claim 7, wherein the blank is wood.

9. The method according to claim 8, wherein the blank is pine.

10. The method according to claim 8, wherein the blank is oak.

11. The method according to claim 7, wherein the blank is nylon.

12. The method according to claim 7, wherein the blank is a material that cures and hardens over time.

13. The method according to claim 12, wherein the blank is comprised of a liquid system that cures to a solid.

14. The method according to claim 13, wherein the blank is comprised of a two-part epoxy system.

15. The method according to claim 12, wherein the blank is comprised of a semi-solid that cures to a solid.

16. The method according to claim 12, wherein the blank is contained in a vessel, and a divider sheet is provided between the workpiece and the vessel walls to isolate the material so that it may harden in two distinct halves.

17. The method according to claim 1, wherein the blank is coated with a protective material after being formed by the workpiece.

18. The method according to claim 1, further comprising the steps of:

a) producing a first molded body using the contoured blank as the pattern, whereby the first molded body is a negative image of the contoured blank; and b) producing a second molded body using the first molded body as the pattern, whereby the second molded body is a negative image of the first molded body and duplicates the shape of the contoured blank and whereby the second molded body may be used as the restrictive tooling.

19. The method according to claim 18, wherein the workpiece has a lower hardness than the restrictive tooling.

20. The method according to claim 18, wherein the first molded body is made of a material having a lower hardness than the material of the second molded body.

21. The method according to claim 18, wherein the second molded body is made of a material having a hardness greater than the hardness of the blank and such hardness is sufficient to allow the second molded body to function as the restrictive tooling.

22. The method according to claim 21, wherein the second molded body is a curable epoxy.

23. The method according to claim 21, wherein the material of the blank may be one from the group comprised of styrofoam material, wax, plaster or plastic.

24. The method according to claim 18, wherein the material of the first molded body and the second molded body may be from one of the group comprised of a thermally curable epoxy or a two-part curable epoxy.

25. A method using an orbital polishing machine for producing restrictive tooling or a pattern or mold from which to produce restrictive tooling that may be used in an orbital polishing operation comprising the steps of:

a) mounting upon a first platen of an orbital grinding machine a workpiece;

b) mounting upon an opposing second platen of the orbital grinding machine a blank made of a material softer than that of the workpiece;

c) energizing the orbital polishing machine to produce relative motion between the workpiece and the blank;

d) advancing the first platen and the second platen toward each other until the workpiece penetrates the blank a predetermined depth to define a cavity or "core";

e) after the cavity has been formed and a contoured blank produced, retracting the first platen and the second platen from each other; and f) using the contoured blank produced by the workpiece to polish the workpiece with flowable abrasive media or to produce a part that will polish the workpiece with flowable abrasive media.

26. The method according to claim 25, wherein outwardly extending surfaces of the workpiece produce proportionately enlarged inwardly extending surfaces on the blank and inwardly extending surfaces of the workpiece produce proportionately reduced outwardly extending surfaces on the blank.

27. The method according to claim 25, wherein the step of energizing the orbital polishing machine imparts oscillatory motion between the workpiece and the blank.

28. The method according to claim 27, wherein the oscillatory motion may be comprised of one from the group of orbital, gyrating, linear, or reciprocating motion.

29. The method according to claim 25, wherein the workpiece has a greater hardness than the blank.

* * * * *

UNITED STATES PATENT AND TRADEMARK OFFICE

CERTIFICATE OF CORRECTION

PATENT NO. : 6,645,056 B1
DATED : November 11, 2003
INVENTOR(S) : James Randall Gilmore et al.

It is certified that error appears in the above-identified patent and that said Letters Patent is hereby corrected as shown below:

Column 1,
Line 13, “whereby’a” should read -- whereby a --.

Column 14,
Lines 47 and 48, “polish the workpiece” should read -- polish that same worpiece --.

Column 16,
Lines 30 and 31, “polish the workpiece” should read -- polish that same workpiece --.
Lines 30 and 31, “with flowable” should read -- with the flowable --.

Signed and Sealed this

Twentieth Day of April, 2004

JON W. DUDAS
*Acting Director of the United States Patent and Trademark Office*